US010676253B2

(12) United States Patent
Brannock

(10) Patent No.: US 10,676,253 B2
(45) Date of Patent: Jun. 9, 2020

(54) LID FOR BEVERAGE CONTAINER

(71) Applicant: Harl-Bella Holdings, LLC, San Juan Capistrano, CA (US)

(72) Inventor: Samuel Lincoln Brannock, San Juan Capistrano, CA (US)

(73) Assignee: Harl-Bella Holdings, LLC, San Juan Capistrano, CA (US)

( * ) Notice: Subject to any disclaimer, the term of this patent is extended or adjusted under 35 U.S.C. 154(b) by 1080 days.

(21) Appl. No.: 14/454,426

(22) Filed: Aug. 7, 2014

(65) Prior Publication Data

US 2015/0031516 A1 Jan. 29, 2015

Related U.S. Application Data

(62) Division of application No. 13/962,878, filed on Aug. 8, 2013, now Pat. No. 8,881,938.

(Continued)

(51) Int. Cl.
*B65D 47/06* (2006.01)
*B65D 43/02* (2006.01)

(52) U.S. Cl.
CPC ..... *B65D 47/06* (2013.01); *B65D 43/0218* (2013.01); *B65D 2203/10* (2013.01); *B65D 2205/02* (2013.01)

(58) Field of Classification Search
CPC ..... B65D 2543/00046; B65D 2543/00092; B65D 2543/00296; B65D 2543/00509;

(Continued)

(56) References Cited

U.S. PATENT DOCUMENTS 562,440 A 6/1896 Vanderall
2,003,657 A 6/1935 Stubblefield (Continued)

FOREIGN PATENT DOCUMENTS

AU 2007100927 A4 11/2007
CA 1236426 5/1988

(Continued)

OTHER PUBLICATIONS

US 6,003,721 A, 12/1999, Fleming (withdrawn)

(Continued)

*Primary Examiner* — Gloria R Weeks
*Assistant Examiner* — Dariush Seif
(74) *Attorney, Agent, or Firm* — Fish IP Law, LLP

(57) ABSTRACT

A lid for a beverage container is described. The lid has a basin that is designed to enhance the user's olfactory experience when drinking a beverage from the container and lid. As the user tilts the container and lid to take a drink, the beverage pours through an opening on the basin valley and flows across a sipping surface area to the user's mouth, thus allowing the beverage to aerate, evaporate, and cool. The basin is sized and dimensioned to channel and concentrate the vapor rising from the beverage towards the user's nose as the user sips the beverage. The basin and the opening are sized and dimensioned to provide a comfortable and secure feeling when drinking hot beverages. In this manner, the lid enhances the drinker's olfactory experience and provides better controllability of the flow of a hot beverage to prevent burn injuries.

18 Claims, 11 Drawing Sheets

Related U.S. Application Data

(60) Provisional application No. 61/833,864, filed on Jun. 11, 2013.

(58) Field of Classification Search
CPC ..... B65D 47/10; B65D 47/103; B65D 47/36; A47G 19/226; A47G 19/2205; A47G 19/2272; A47G 19/2227
USPC ..... 220/703, 711, 712, 713, 716, 717, 718; 215/386, 387; 493/340
See application file for complete search history.

(56) References Cited

U.S. PATENT DOCUMENTS 2,316,516 A * 4/1943 Hammerstein ..... A47G 19/24 215/11.1
2,600,478 A 6/1952 Campomar
2,646,670 A 7/1953 Spalding
2,661,889 A 12/1953 Phinney
2,753,049 A 7/1956 Gaines
3,090,542 A 5/1963 Miller
3,302,858 A 2/1967 Miller
3,341,062 A 9/1967 Phillips
3,727,808 A 4/1973 Fitzgerald
3,730,399 A 5/1973 Dibrell
3,777,968 A 12/1973 Law
3,800,999 A 4/1974 Serritella
3,806,023 A 4/1974 Barnett
3,860,162 A 1/1975 Schutz
3,868,043 A 2/1975 Freemyer
3,895,743 A 7/1975 Christian
3,920,146 A 11/1975 Baller
3,938,695 A 2/1976 Ruff
3,977,559 A 8/1976 Lombardi
3,977,562 A 8/1976 Wedzik
3,994,411 A * 11/1976 Elfelt ..... B65D 43/0256 220/269
4,056,210 A 11/1977 Boyle
4,081,103 A 3/1978 Zoellick
4,085,861 A 4/1978 Ruff
4,090,660 A 5/1978 Schram
4,106,660 A 8/1978 Boyle
4,113,135 A 9/1978 Yamazaki
4,138,033 A 2/1979 Payne
4,141,462 A 2/1979 Rucci
4,183,443 A 1/1980 DeParales
4,184,604 A 1/1980 Amberg
4,187,954 A * 2/1980 Striggow ..... B65D 47/103 215/253
4,202,459 A 5/1980 DeParales
4,210,272 A 7/1980 Sequin
4,215,793 A 8/1980 Packard
D256,887 S 9/1980 Swade
D256,888 S 9/1980 Swade
D256,889 S 9/1980 Swade
4,245,752 A * 1/1981 Prueher ..... B65D 47/2018 215/311
4,253,582 A 3/1981 Shields
D259,403 S 6/1981 Frazier, Jr.
4,285,442 A 8/1981 Wedzik
4,319,691 A 3/1982 Hament
4,322,014 A 3/1982 Philip
4,322,015 A 3/1982 Bailey
4,331,255 A 5/1982 Fournier
4,350,260 A * 9/1982 Prueher ..... B65D 47/2018 220/254.3
4,361,249 A 11/1982 Tuneski
D267,633 S 1/1983 Christian
4,412,629 A * 11/1983 Dart ..... B65D 21/0219 220/254.1
4,413,748 A * 11/1983 Kessler ..... B65D 43/021 220/212.5
D271,857 S 12/1983 Callahan
D274,502 S 7/1984 Little
4,473,167 A 9/1984 Bailey
4,489,848 A * 12/1984 Braude ..... B65D 21/022 206/508
4,502,608 A 3/1985 Mills
4,503,992 A 3/1985 Sitko
4,518,096 A 5/1985 Winstead
4,566,605 A * 1/1986 Rogers ..... B65D 47/103 220/712
4,574,970 A 3/1986 Schwarz
4,582,214 A 4/1986 Dart
4,619,372 A 10/1986 McFarland
4,627,537 A 12/1986 Rogers
4,670,352 A 6/1987 Kurz
4,738,373 A 4/1988 DeParales
4,747,509 A 5/1988 Florkiewicz
4,753,365 A 6/1988 Seppala
4,760,934 A 8/1988 Netsch
D299,010 S 12/1988 Wall
4,818,461 A 4/1989 Batson
4,828,137 A 5/1989 Batson
4,877,391 A 10/1989 Batson
4,898,299 A 2/1990 Herbst
4,949,865 A 8/1990 Turner
4,986,437 A 1/1991 Farmer
5,090,584 A 2/1992 Roberts
5,143,248 A 9/1992 Sawatsky
5,150,816 A 9/1992 DeCastro
5,197,624 A 3/1993 Dodaro
D355,846 S 2/1995 Denney
5,390,810 A * 2/1995 Stroble ..... B65D 47/2018 220/281
5,392,949 A * 2/1995 McKenna ..... B65D 47/0847 220/266
5,431,276 A 7/1995 Lialin
D362,156 S 9/1995 Goto
D365,247 S 12/1995 Sokolski
5,490,609 A 2/1996 Lane
D369,109 S 4/1996 Proshan
5,503,289 A 4/1996 Fox
5,540,350 A 7/1996 Lansky
D373,927 S 9/1996 Kramer
5,613,619 A 3/1997 Van Melle
D382,203 S 8/1997 Fonville
5,699,927 A 12/1997 Lane
5,706,972 A 1/1998 Sousa
D390,465 S 2/1998 Frye
5,799,814 A 9/1998 Schaefer
5,820,016 A 10/1998 Stropkay
5,839,601 A 11/1998 Van Melle
5,897,019 A 4/1999 Stropkay
5,911,331 A 6/1999 Boller
5,947,323 A 9/1999 Freek
5,979,689 A 11/1999 Lansky
6,076,450 A 6/2000 DiGiorgio, Jr.
6,089,397 A 7/2000 Van Melle
6,102,236 A 8/2000 Ohlsson
6,138,854 A 10/2000 Kaneko
6,199,711 B1 3/2001 Lansky
D447,412 S 9/2001 Durdon
D450,583 S 11/2001 Freed
6,311,863 B1 11/2001 Fleming
6,375,033 B1 4/2002 Fleming
6,378,718 B1 4/2002 Maggi
6,419,105 B1 * 7/2002 Bruce ..... B65D 47/06 220/266
6,419,112 B1 * 7/2002 Bruce ..... B65D 21/0219 206/509
6,488,170 B1 12/2002 Johnson
6,505,753 B1 1/2003 Freek
D470,008 S 2/2003 Trombly
D473,791 S 4/2003 Loris
6,553,696 B1 4/2003 Foster, Sr.
6,612,456 B1 9/2003 Hundley
6,763,964 B1 * 7/2004 Hurlbut ..... A47G 19/2272 220/254.2
D493,718 S 8/2004 Durdon
6,783,019 B2 8/2004 Zettle
6,889,859 B1 5/2005 Leon
6,889,860 B2 5/2005 Mazzarolo

(56) References Cited

U.S. PATENT DOCUMENTS 6,929,143 B2 8/2005 Mazzarolo
6,948,633 B2 9/2005 Freek
D525,826 S 8/2006 Kugler
D527,219 S 8/2006 Trombly
7,100,790 B2 9/2006 Dark
7,134,569 B2 11/2006 Freek
7,134,570 B1 11/2006 Heath
D533,778 S 12/2006 Hollis
7,168,589 B2 1/2007 Dark
D539,646 S 4/2007 Hollis
D540,165 S 4/2007 Hollis
D540,166 S 4/2007 Hollis
D540,672 S 4/2007 Hollis
D540,673 S 4/2007 Hollis
D540,674 S 4/2007 Hollis
D540,675 S 4/2007 Hollis
D541,153 S 4/2007 Hollis
D541,650 S 5/2007 Hollis
D541,651 S 5/2007 Hollis
D544,793 S 6/2007 Hollis
7,275,652 B2 10/2007 Morris
D556,573 S 12/2007 Hollis
D556,574 S 12/2007 Hollis
D570,213 S 6/2008 Newman
D570,685 S 6/2008 Koennecke
D570,686 S 6/2008 Hollis
7,484,638 B2 2/2009 Mazzarolo
7,537,129 B2 5/2009 Bayss et al.
D612,237 S 3/2010 Richey
D612,687 S 3/2010 Gilbert
D615,413 S 5/2010 Gilbert
7,731,047 B2 6/2010 Ishimitsu
D622,103 S 8/2010 Gilbert
D627,192 S 11/2010 Gilbert
D632,174 S 2/2011 Charbonnet
7,954,659 B2 * 6/2011 Zuares ..... B65D 47/0804 220/254.3
7,959,028 B2 6/2011 Leon
8,016,507 B2 * 9/2011 Wright ..... A45D 34/00 401/266
8,113,379 B2 2/2012 Cai
8,272,318 B2 9/2012 Skalski
D704,054 S 5/2014 Fleming
D704,055 S * 5/2014 Fleming ..... D9/447
D705,058 S * 5/2014 Kim, II ..... D9/447
D711,226 S * 8/2014 Fleming ..... B65D 43/02 D9/435
8,881,938 B2 * 11/2014 Brannock ..... B65D 47/06 215/387
8,950,623 B2 * 2/2015 Fleming ..... B65D 43/02 220/713
9,016,503 B2 * 4/2015 Barbier ..... B65D 43/162 220/266
9,027,774 B2 * 5/2015 Palmer ..... B65D 47/043 220/287
D756,773 S * 5/2016 Brannock ..... D9/438
9,809,332 B2 * 11/2017 Valencia ..... B65B 5/024
2002/0074337 A1 6/2002 Melton
2002/0100757 A1 8/2002 Shih
2003/0089713 A1 5/2003 Belt
2003/0089714 A1 5/2003 Dart
2003/0102312 A1 6/2003 Horner
2003/0116568 A1 * 6/2003 Clarke ..... B65D 43/0212 220/254.3
2003/0168455 A1 9/2003 Zettle
2004/0195239 A1 10/2004 Rush
2005/0224495 A1 10/2005 Kartinian
2005/0230403 A1 10/2005 Dark
2006/0255043 A1 * 11/2006 Tedford, Jr. ..... B65D 43/0212 220/375
2007/0012709 A1 1/2007 Durdon
2007/0045316 A1 3/2007 Arnljots
2007/0075079 A1 4/2007 Stokes
2007/0075081 A1 4/2007 Stokes
2007/0114236 A1 5/2007 Shiffer
2007/0251948 A1 11/2007 Baker
2008/0000920 A1 1/2008 Ho
2008/0000921 A1 1/2008 Leon
2008/0011762 A1 * 1/2008 Boone ..... B65D 43/0212 220/713
2008/0041862 A1 2/2008 Bal
2008/0047966 A1 2/2008 Carson
2008/0061069 A1 * 3/2008 Edelstein ..... B65D 43/0212 220/713
2008/0105696 A1 5/2008 Dart
2008/0217345 A1 9/2008 Hansen
2009/0026219 A1 1/2009 Bal
2009/0078698 A1 * 3/2009 Middleton ..... B65D 5/4204 219/729
2009/0250479 A1 10/2009 Kaufman
2009/0266828 A1 * 10/2009 Cai ..... B65D 43/0212 220/712
2009/0266829 A1 10/2009 Bailey
2010/0012657 A1 1/2010 Levey
2010/0059535 A1 3/2010 Syrkos
2010/0206874 A1 8/2010 Masurier
2010/0243652 A1 9/2010 Richey
2010/0252555 A1 10/2010 Syed
2010/0282829 A1 * 11/2010 Jackson ..... B65D 3/261 229/125.42
2010/0288768 A1 11/2010 Booth
2010/0288827 A1 11/2010 Booth
2010/0301048 A1 * 12/2010 Tokunaga ..... A47G 19/2205 220/367.1
2011/0049171 A1 * 3/2011 Morgan ..... B65D 43/0212 220/712
2011/0062158 A1 3/2011 Hung
2011/0100854 A1 5/2011 Chapin
2011/0114655 A1 * 5/2011 Bailey ..... B65D 43/0214 220/713
2011/0155732 A1 6/2011 Sprunger
2011/0180560 A1 7/2011 Hung
2011/0233209 A1 9/2011 Tu
2011/0266294 A1 11/2011 Charbonnet
2011/0278314 A1 11/2011 Bendix
2011/0284564 A1 11/2011 Hsieh
2011/0290815 A1 12/2011 Weld
2012/0000923 A1 1/2012 Powell
2012/0152968 A1 6/2012 Bailey
2012/0199584 A1 8/2012 Pensak
2012/0205390 A1 8/2012 Portman
2012/0210880 A1 8/2012 Kolesnyk
2012/0219685 A1 8/2012 Radow
2012/0234701 A1 * 9/2012 Albrecht ..... B65D 83/0463 206/1.5
2012/0261417 A1 10/2012 Tabor et al.
2012/0263831 A1 10/2012 Skalski
2012/0312827 A1 12/2012 Zuares et al.
2013/0020338 A1 1/2013 French et al.
2013/0277379 A1 10/2013 Charbonnet
2014/0042177 A1 * 2/2014 Fleming ..... B65D 43/02 220/713
2014/0042178 A1 * 2/2014 Brannock ..... B65D 47/06 220/713
2014/0123607 A1 * 5/2014 Valencia ..... B65D 77/2024 53/476
2014/0183198 A1 * 7/2014 Slack ..... B65D 25/16 220/495.01
2016/0075491 A1 * 3/2016 Brannock ..... B65D 43/0212 220/712
2016/0345762 A1 * 12/2016 Brannock ..... A47G 19/2272

FOREIGN PATENT DOCUMENTS

CA 1324342 11/1993
CA 2031703 5/1996
CA 2136579 A1 5/1996
CA 2169339 C 5/1999
CA 2245369 A1 9/2000
CA 2622689 A1 8/2009
CN 1248951 A 3/2000
CN 2603023 Y 2/2004

(56) References Cited

FOREIGN PATENT DOCUMENTS

| | | | |
|---|---|---|---|
| CN | 2870658 | | 3/2006 |
| CN | 201068255 | Y | 6/2008 |
| CN | 201079228 | | 7/2008 |
| CN | 201750772 | U | 2/2011 |
| CN | 201938947 | U | 8/2011 |
| DE | 202010005134 | U1 | 8/2010 |
| DE | 202010013715 | U1 | 12/2010 |
| EP | 0367483 | A2 | 10/1989 |
| EP | 0398122 | A1 | 11/1990 |
| EP | 427684 | A2 | 5/1991 |
| EP | 2248735 | A1 | 11/2010 |
| EP | 2295338 | A1 | 3/2011 |
| GB | 1599589 | | 10/1981 |
| GB | 2219930 | A | 12/1989 |
| GB | 2243149 | A | 10/1991 |
| GB | 2473041 | A | 3/2011 |
| GB | 2473042 | A | 3/2011 |
| GB | 2473043 | A | 3/2011 |
| JP | 09124057 | A | 5/1997 |
| JP | 09142469 | A | 6/1997 |
| JP | 2600723 | Y2 | 10/1999 |
| JP | 2000103469 | A | 4/2000 |
| JP | 2000287808 | A | 10/2000 |
| JP | 2001206413 | A | 7/2001 |
| JP | 2004244051 | A | 9/2004 |
| JP | 2008308225 | A | 12/2005 |
| JP | 2008308224 | A | 12/2008 |
| JP | 2011255944 | A | 12/2011 |
| KR | 1020020021950 | A | 3/2002 |
| KR | 200409095 | Y1 | 2/2006 |
| KR | 2020110008147 | U | 8/2011 |
| TW | 465326 | U | 11/2001 |
| TW | M318382 | U | 9/2007 |
| TW | M323449 | U | 12/2007 |
| TW | M323450 | U | 12/2007 |
| TW | M333128 | U | 6/2008 |
| TW | I298997 | | 7/2008 |
| TW | 200846256 | A | 12/2008 |
| TW | M384844 | U | 7/2010 |
| TW | M386271 | U | 8/2010 |
| TW | D138422 | S | 1/2011 |
| TW | M405420 | U | 6/2011 |
| WO | 200146027 | A1 | 6/2001 |
| WO | WO0156899 | A1 | 8/2001 |
| WO | 0156899 | A1 | 9/2001 |
| WO | 2004087510 | A2 | 10/2004 |
| WO | 2007078265 | A2 | 7/2007 |
| WO | 2008018798 | A1 | 2/2008 |
| WO | 2009008587 | A1 | 1/2009 |
| WO | WO2009022745 | A1 | 2/2009 |
| WO | 2009126555 | | 10/2009 |
| WO | 2011024012 | A1 | 3/2011 |
| WO | 2011082333 | | 7/2011 |
| WO | 2012104385 | A1 | 8/2012 |
| WO | 2013142160 | A1 | 9/2013 |

OTHER PUBLICATIONS http://www.singleservecoffee.com/archives/040040.php, Ecotop Reusable Coffee Cup Lid, May 15, 2012.

The Geo Lid; Green Bean Packaging, LLC; www.thegeolid.com; Web; 2012-2014; retrieved Jan. 2014.

International Preliminary Report on Patentability for International Application No. PCT/US2014/050422 dated Sep. 4, 2015, 12 pages.

USPTO Office Action in U.S. Appl. No. 13/962,878 dated Nov. 25, 2013; 31 pages.

Canadian Intellectual Property Office Office Action for Application No. 2949166 dated Nov. 3, 2017; 4 pages.

Canadian Intellectual Property Office Office Action for Application No. 2954254 dated Sep. 27, 2017; 7 pages.

USPTO Office Action in U.S. Appl. No. 14/948,031 dated Feb. 11, 2016; 11 pages.

USPTO Office Action in U.S. Appl. No. 13/962,878 dated Apr. 24, 2014; 31 pages.

USPTO Office Action in U.S. Appl. No. 14/948,031 dated Aug. 11, 2016; 22 pages.

* cited by examiner 100
407
402
301
305
307
310
313
304
308
302
312
311
314
315
401
306

100
503a
503b
504

FIG. 8A
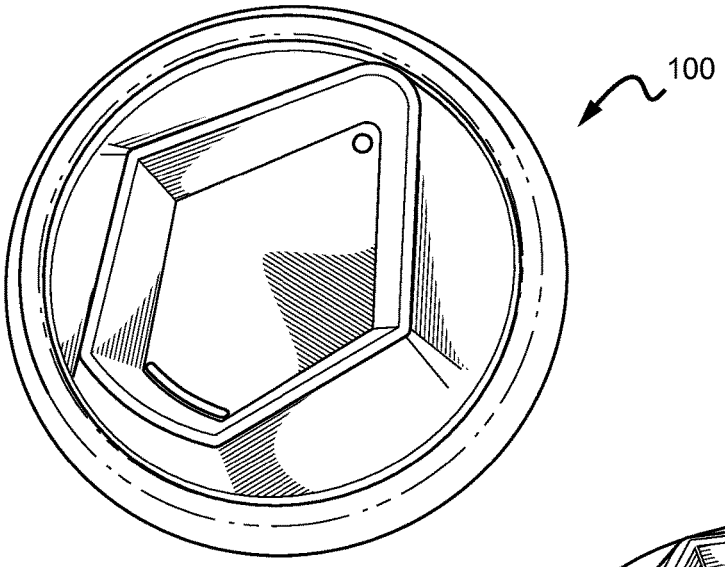
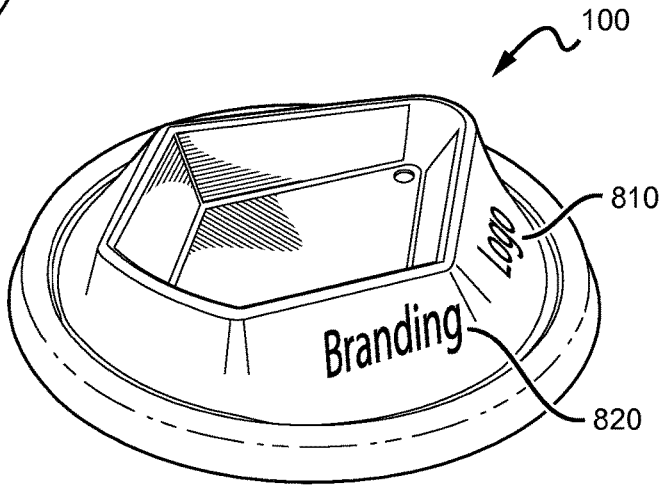
FIG. 8B
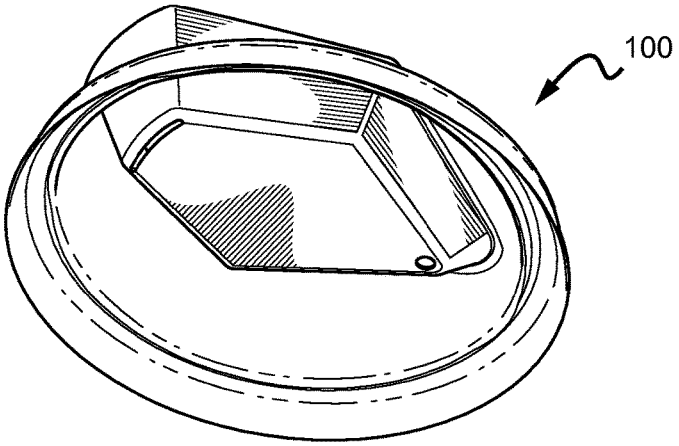
FIG. 8C

FIG. 17A
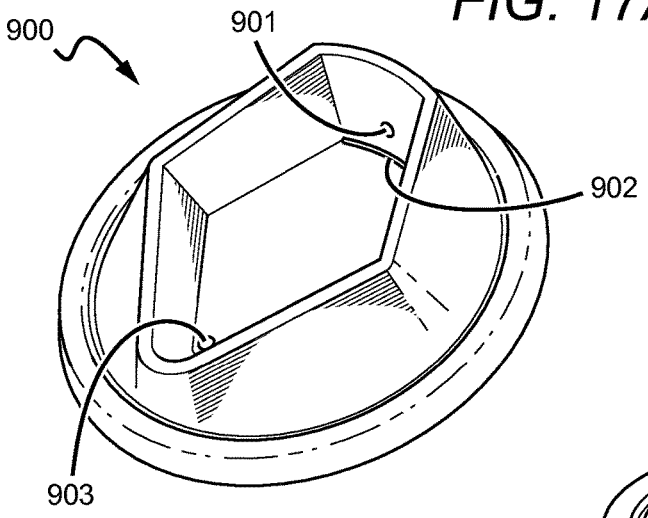
FIG. 17B
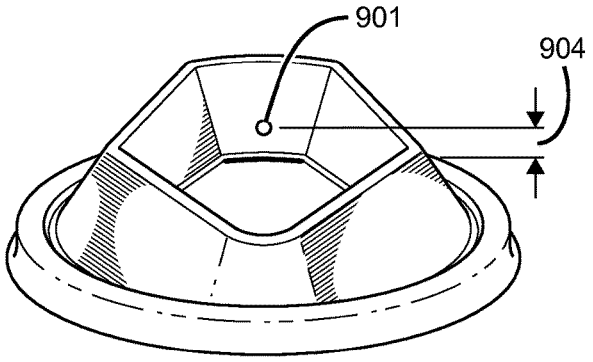
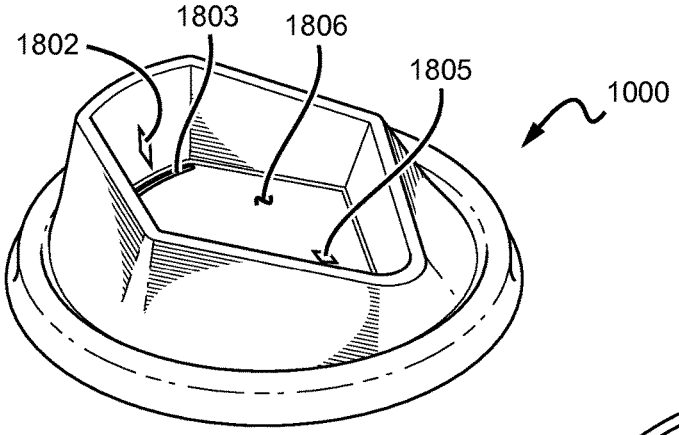
FIG. 18A
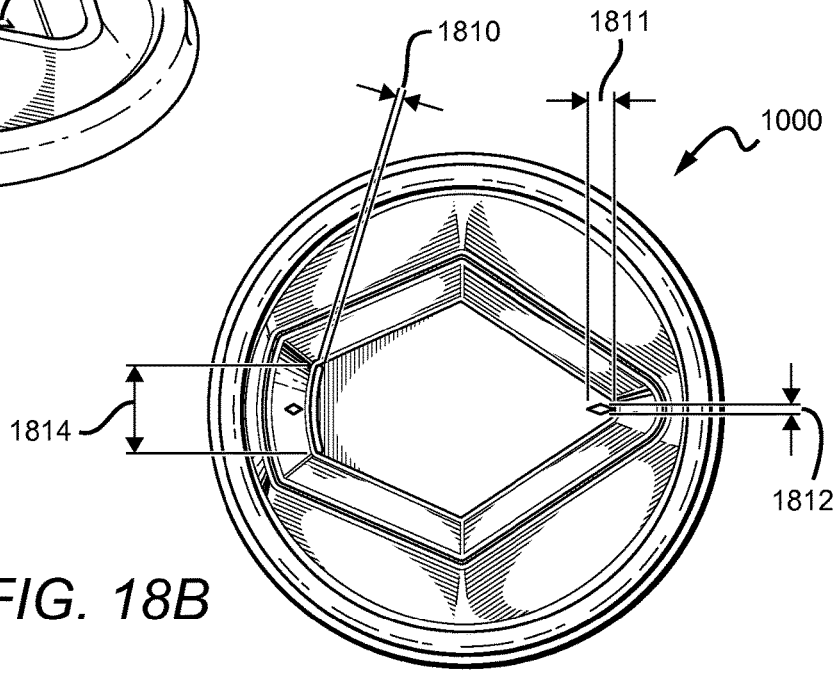
FIG. 18B

FIG. 21A
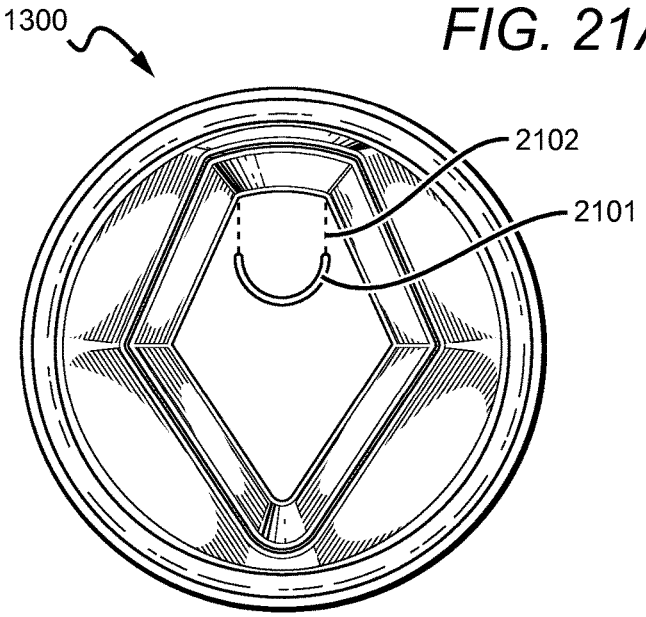
FIG. 21B
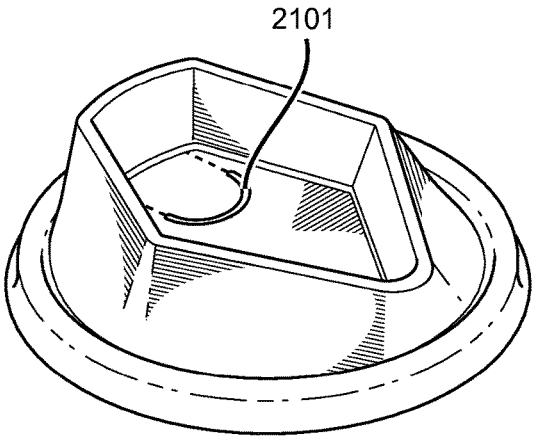
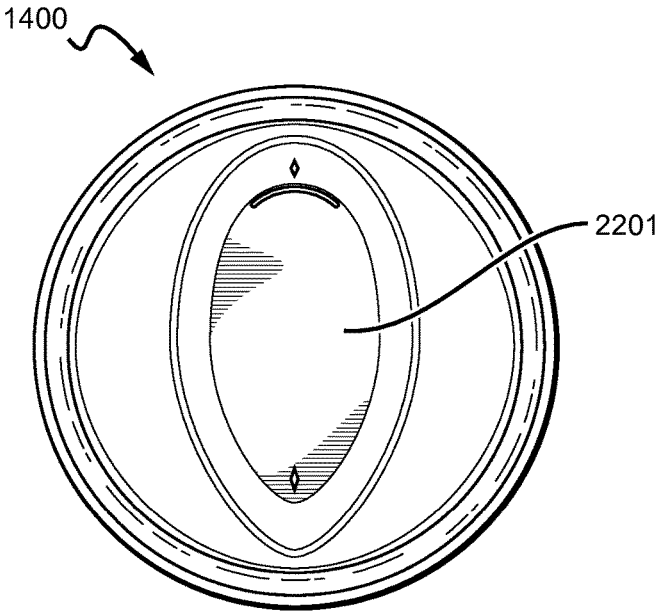
FIG. 22A
FIG. 22B
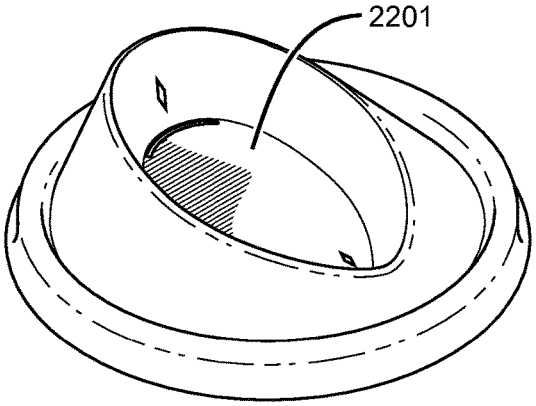

FIG. 23A
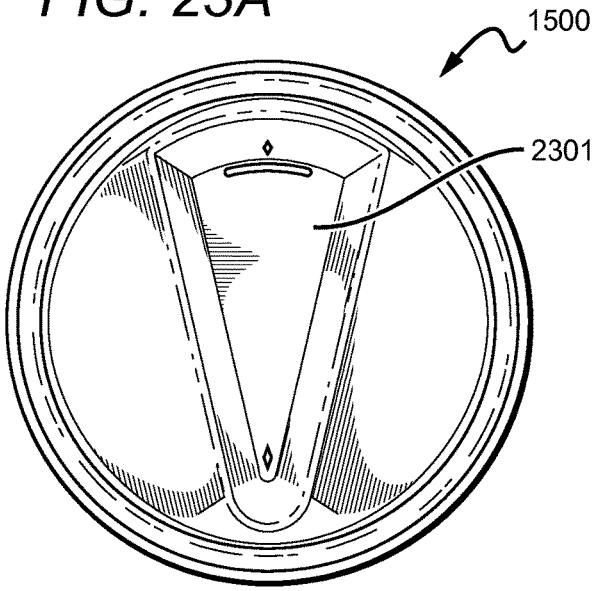
FIG. 23B
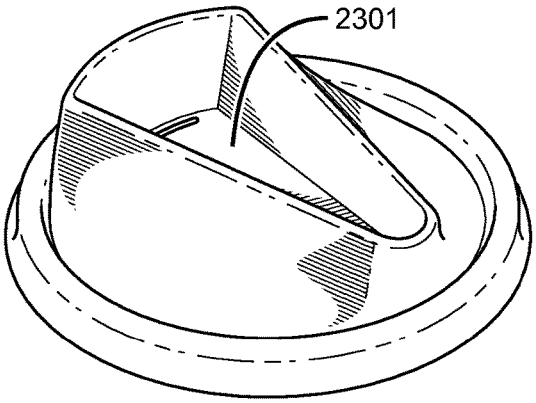
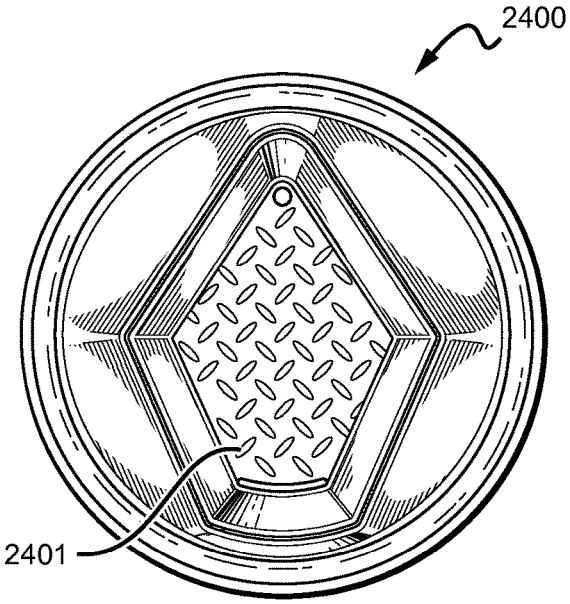
FIG. 24
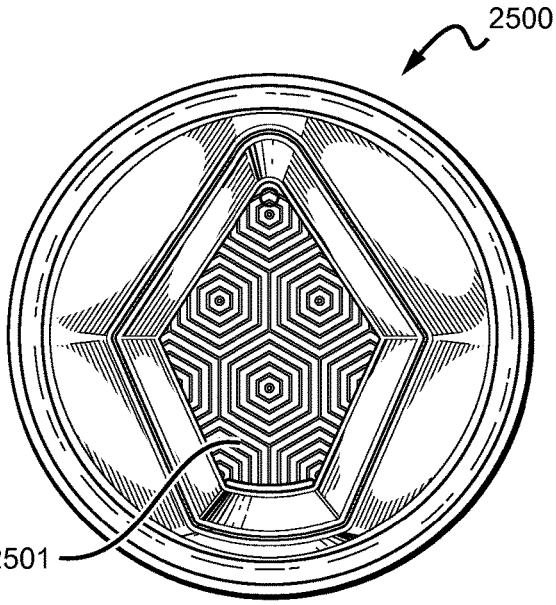
FIG. 25

LID FOR BEVERAGE CONTAINER

This application is a divisional of, and claims priority to, U.S. application Ser. No. 13/962,878, filed on Aug. 8, 2013, which claims priority to U.S. Provisional Patent Application No. 61/833,864 filed Jun. 11, 2013; U.S. Provisional Patent Application No. 61/763,393 filed Feb. 11, 2013; U.S. Provisional Patent Application No. 61/706,487 filed Sep. 27, 2012; U.S. Provisional Patent Application No. 61/681,017 filed Aug. 8, 2012, each of which is incorporated herein by reference in its entirety.

FIELD OF THE INVENTION

The field of the invention is lids, more specifically, lids for enhancing the comfort, safety, and olfactory experience when drinking beverages.

BACKGROUND

The following description includes information that may be useful in understanding the present invention. It is not an admission that any of the information provided herein is prior art or relevant to the presently claimed invention, or that any publication specifically or implicitly referenced is prior art.

The olfactory perception of consumers is an important factor to consider when developing a certain beverage. Through the sense of smell, consumers can gauge the freshness of a product and can sometimes determine whether they will like the product before consuming. As such, a pleasant aroma can induce consumers into trying the product and the overall experience can be enhanced by consuming a product with the combination of a pleasant smell and taste. Unfortunately, many consumers on the go are deprived of this olfactory experience because a majority of beverage containers have lids that fail to provide a means of smelling the aroma of the beverage.

Some have recognized this flaw and have attempted to remedy the problem. One example of such is WO 2011/082333 to Sprunger, which discloses a beverage lid that has a pod (e.g., compartment) filled with aromatic material (e.g., coffee grind). The lid allows vapor rising from a hot beverage to pass through the aroma pod and to the user's nose. Unfortunately, this approach can be problematic if the aromatic material is accidentally wetted while filling the beverage container or drinking from the beverage container. In addition, the lid is relatively large and expensive since it requires a pod with an aromatic material.

A similar approach is described in WO 2009/126555 to Kaufman, which discloses a beverage lid that has a compartment for holding a sample of fresh beverage material. The compartment is placed near the user's nose, allowing the user to smell the beverage material when drinking from the lid. While the Kaufman lid can provide a pleasant aroma of fresh material, this approach is troublesome for those consumers that desire repeated use.

In another approach, GB 2473041 and GB 2473042 to Brown disclose a cup lid having a curved rim surface that is higher at the drinking aperture. The beverage flows through a liquid guide trough, which exposes the liquid to the air adjacent to the user's nose. Unfortunately, a user may run the risk of burning his/her upper lip because the lid's curved rim surface places the user's upper lip into the flow of the beverage in the guide trough. (In fact, Brown states that the user may desire to use their upper lip to test whether the beverage is too hot to drink. See Brown at page 25, lines 14-20.) Brown also fails to provide a controlled beverage flow rate and a comfortable/secure feeling for drinking hot beverages. Furthermore, Brown fails to contain and redirect the aroma to a concentrated point near the user's nose.

Finally, US 2011/0114655 to Bailey provides a cup lid that has a scent aperture positioned near the user's nose to allow aroma from the beverage to reach the user. Unfortunately, this approach increases the risk of spilling via the additional aperture. This approach also fails to allow the beverage to aerate outside of the container as it flows to the user's mouth.

Other beverage lids include the following: AU 2007100927 to Wall (a coffee lid that contains an advertisement); U.S. Pat. No. 3,806,023 to Barnett (a lid that has a concave main body portion that allows hot liquid to cool); US 2007/0012709 to Durdon (a lid having a drink-through opening and a stopper, which can be used to plug drink-through opening); US 2007/0075079 to Stokes (a lid having a beverage spout through which a primary liquid can flow and a sip hole through which a flavoring can flow); US 2008/0000921 to Leon (a lid having a spout and openings that allow liquid and vapor to pass through); US 2011/0100854 to Chapin (a can top shaped with grooves that reduces a build-up of debris); US 2012/0152968 to Bailey; US20120205390 (Portman); and WO2012104385 (Elias).

All publications cited herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved lids that enhance the olfactory experience of drinking an aromatic beverage and that provide better comfort and protection when drinking hot beverages.

SUMMARY OF THE INVENTION

The inventive subject matter provides apparatus, systems, and methods in which a lid for a beverage container enhances the user's olfactory experience. The lid has a basin with a valley and a ridge surrounding the valley. The valley has an opening (e.g., spout) for allowing the beverage to pass through. The valley may optionally include a second opening (e.g., air hole) that allows for the exchange of air between the interior of the container and the surrounding environment, thus preventing a vacuum from forming within the container.

In one aspect of some embodiments, the basin has an elongated shape that gradually becomes narrower across the length of the basin (e.g., the basin's ridges become closer together). The wider end of the basin is the drinking portion of the basin (i.e., the proximal portion) and the narrower end is the aroma portion (i.e., the distal portion). When the lid is placed on a container and the container is tilted, the liquid beverage passes through the opening near the drinking portion of the basin, which allows the liquid to aerate, cool, and evaporate. Vapor rising from the liquid is channeled to, and concentrated at, the user's nose due to the design of the lid.

In another aspect of some embodiments, the basin has a drinking portion defined by the shape of the ridge as seen from a top view. More specifically, the ridge has an inward-facing surface and a first portion of the inward facing surface, referred to herein as the sipping surface, (i) intersects a second portion of the inward-facing wall at a first angle (at one end of the first portion) and (ii) intersects a third portion of the inward-facing wall at a second angle (at the other end of the first portion). The first and second angles are between 90 and 135 degrees and face one another in a mirrored fashion to form a controlled and contained sipping area.

In such embodiments, the distance between the second and third portions (i.e., the length of the first portion) and the height of the second and third portions can be sized and dimensioned to push the user's upper lip away from the sipping surface to reduce the likelihood of spills and burns and to provide a more comfortable and secure feeling when drinking hot beverages. In another aspect of such embodiments, the first and second angles form first and second creases in the inward-facing surface of the ridge. The first and second creases (see first crease 1105 and second crease 1107 in FIG. 11) can include a plurality of perforations or a solid tear line, which allows the user to enlarge the lid's spout opening by pinching or pushing the inward-facing surface between the perforations.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 8*a* is a top perspective view of the lid of FIG. 1.

FIG. 8*b* is a top perspective view of the lid of FIG. 1 with a branding logo.

FIG. 8*c* is a bottom perspective view of lide of FIG. 1.

FIGS. 17*a-b* are perspective views of another embodiment of a lid with a basin.

FIG. 18*a-b* are perspective views of another embodiment of a lid with a basin

FIGS. 21*a-b* are perspective views of another embodiment of a lid with a basin.

FIGS. 22*a-b* are perspective views of another embodiment of a lid with a basin.

FIGS. 23*a-b* are perspective views of another embodiment of a lid with a basin.

FIG. 24 is a top view of another embodiment of a lid with a basin, wherein the basin valley is textured.

FIG. 25 is a top view of another embodiment of a lid with a textured basin valley.

DETAILED DESCRIPTION

One should appreciate that the lids described herein provide many advantageous technical effects such as channeling and concentrating aroma of a beverage towards a user's nose to enhance aroma of a beverage.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
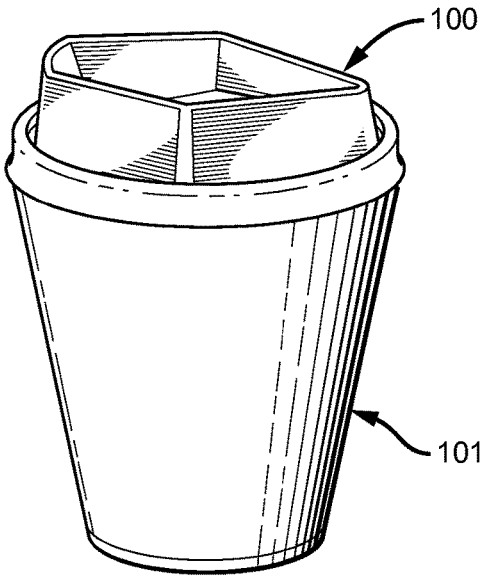
FIG. 1 is a perspective view of one embodiment of a lid that has a basin, the lid coupled with a container.

FIG. 1 shows a lid 100 coupled with a container 101. Lid 100 and container 101 are oriented in a resting position (e.g., container 101 is substantially vertical, as if resting on a horizontal plane such as a table surface).

Figure 2:
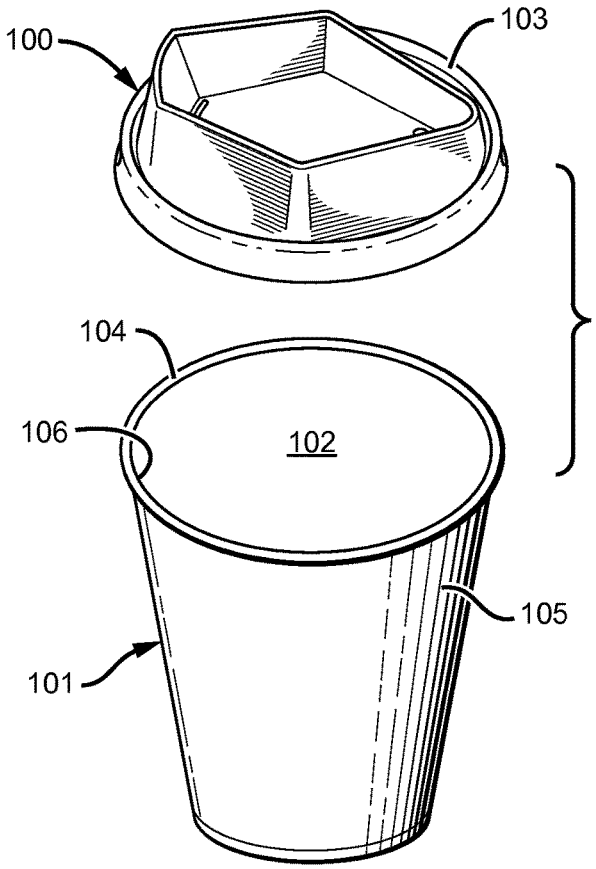
FIG. 2 is a perspective view of the lid and container of FIG. 1 in a separated configuration.

Lid 100 is removably coupled with container 101. FIG. 2 shows lid 100 and container 101 separated from one another. Container 101 has a lumen 102 defined by a side wall 105 and a bottom. Lumen 102 can be used to store a beverage such as water, juice, soda, tea, coffee, and hot cocoa. Container 101 also has an opening 106 defined by a rim 104 from which a user can drink the beverage. Lid 100 has a rim 103 that has a slightly larger diameter than rim 104 of container 101, thus allowing lid 100 to removably couple with container 101 (e.g., rim 103 press-fits over rim 104). When coupled with container 101, lid 100 advantageously reduces the size of the opening of container 101 to contain a liquid and prevent spilling.

In other embodiments, lid 100 and container 101 can be removably coupled using threaded engagements, snap fittings, male-female engagements, or any other fastener suitable for sealing a liquid within lumen 102. In yet other embodiments, lid 100 and container 101 can be permanently coupled. For example, lid 100 and container 101 could be manufactured as one integral structure and a liquid could be placed inside lumen 102 prior to completion of the manufacturing process.

Lid 100 and container 101 can be made of any material suitable for containing a liquid (e.g., the material is substantially impermeable to the liquid). Lid 100 and/or container 101 can also be made of a material that helps insulate the temperature of the beverage from the temperature of the surrounding environment. The material may also be configured and/or chosen to withstand sudden temperature changes and have relatively low manufacturing costs (e.g., raw materials are inexpensive; material can be used in low cost manufacturing processes). Lid 100 and/or container 101 could also include a thermochromic material to indicate the temperature of the beverage or peizochromic material around edges of lid to indicate a proper seal with the beverage cup. In addition, lid 100 and/or container 101 could be made of a biodegradable material to reduce negative environmental impact when disposed. Lid 100 could also be made of a disposable or non-disposable material. As used herein, "non-disposable material" means a material that is configured for withstand many uses. In some embodiments, a non-disposable material could still comprise a material that is environmentally friendly and/or biodegradable. Contemplated materials include, but are not limited to, high-density polyethylene (HDPE), polystyrene, polypropylene (PP), polyethylene terephthalate (PET), silicone material, bio-plastics, fiber-based materials, metal alloys, ceramics, composites, and any combination thereof.

Figure 4:
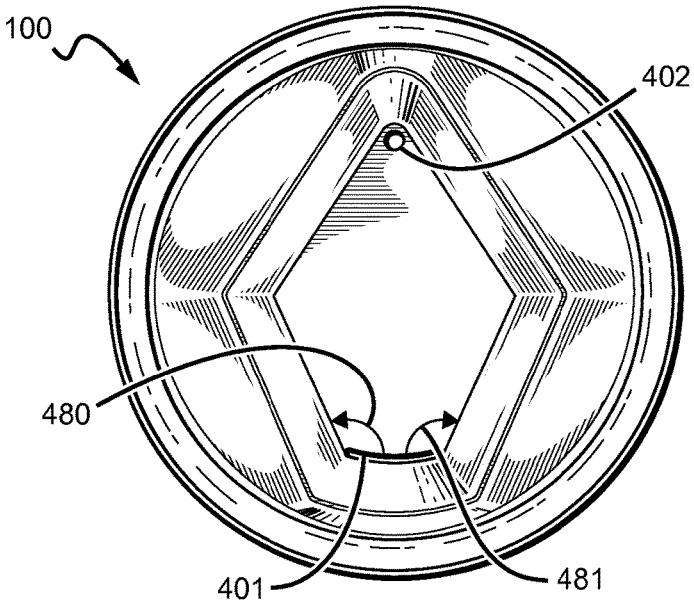
FIG. 4 is another top view of the lid of FIG. 1.
Figure 3:
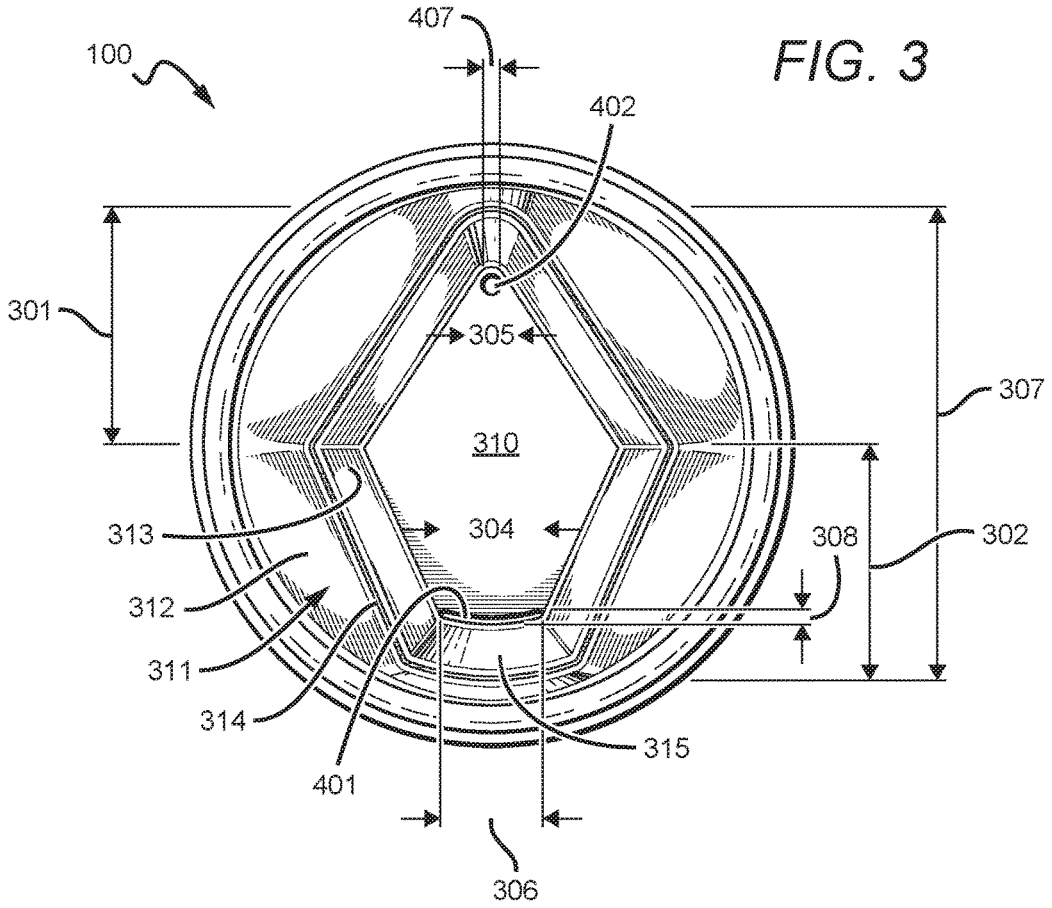
FIG. 3 is a top view of the lid of FIG. 1.

FIG. 3 shows a close-up top view of lid 100. FIG. 4 shows a close-up bottom view of lid 100. Lid 100 has a basin 310 (e.g., concavity) comprising a valley (also referred to as a base) surrounded by a ridge 311 (e.g., an elevated wall). The ridge 311 can be of constant height, or of varying heights. Moreover, ridge 311 has an outward-facing wall 312 (also referred to as outer surface) and an inward-facing wall 313 (also referred to as inner surface). Outward-facing wall 312 raises above rim 103 and is sufficiently large to display a graphic (e.g., a symbol, logo, drawing, text, etc.). Portions of outward-facing wall 312 are sloped at about 70 degrees with respect to a horizontal plane, making it visible by others. Inward-facing wall 313 slopes down from the top of ridge 314 in a concave manner and joins with the valley of basin 310. The exact boundary between inward-facing wall 313 and the valley of basin 310 may not be readily apparent since inward-facing wall 313 slopes down gradually into the valley.

Basin 310 has a slit opening 401 (e.g., slot, spout, etc.) disposed on the surface of the valley. Opening 401 is slightly concave and matches the contour of ridge 311 at the drinking portion of lid 100. In other embodiments, opening 401 could be substantially planar. Opening 401 is sized, dimensioned, and positioned to provide an outlet for dispensing the liquid. In alternative embodiments, opening 401 can comprise numerous shapes other than slits, such as a circular opening (see e.g., opening 2101 in FIG. 21), triangular openings (see e.g., openings 2020 in FIG. 20), rectangular openings, and so forth. In addition, it should be appreciated that lid 100 can have multiple openings to dispense the liquid as shown in the some of the examples below. The size, dimension, shape, and placement of slit opening 401 is especially configured to control the flow rate of the liquid and provides a variety of safeguards for consumers. For example, opening 401 reduces hazardous (i) splashing of the beverage onto the consumer, and (ii) burning of the consumer drinking a hot beverage. Opening 401 is also located close to the intersection of inward-facing wall 313 and basin 310, so as to reduce and/or eliminate the volume of non-dispensable liquid within the beverage container.

In some embodiments, opening 401 is located at an optimal distance from the proximal ridge (or from the wall of the container) so as to prevent a specific volume of the beverage from being dispensed. In this manner, the lid prevents unwanted coffee grinds or sediment such as from tea from being dispensed.

Basin 310 also has second opening 402 that is sized, dimensioned, and positioned so as to allow air flow while avoiding liquid flow when dispensing liquid from opening 401. Second opening 402 helps to maintain atmospheric pressure within lumen 102 when the liquid is dispensed. However, it is contemplated that other means can be used to help maintain atmospheric pressure, such that second opening 402 is not needed (e.g., larger openings for outlet dispensing).

FIG. 3 shows various dimensions of lid 100. Basin 310 has a length consisting of a first length 301 and a second length 302. At the end of the first length 301 (i.e., the portion that is distal to the user's mouth) is an aroma portion. At the end of second length 302 (i.e., the portion that is proximal to the user's mouth and near the user's nose) is a drinking portion. The valley of basin 310 and/or inward-facing wall 313 at drinking portion is configured to allow liquid to flow across a sipping area 315 when the liquid is dispensed from opening 401 (e.g., when the lid is tilted/angled with respect to a horizontal plane). While sipping area 315 is substantially planar (see FIG. 5), sipping area 315 could also be slightly curved (e.g., concavity) to allow for temporary pooling of the beverage. Sipping area 315 advantageously allows at least a portion of the liquid to cool, aerate, and evaporate. Sipping area 315 also allows the user to sip the beverage, which allows better control over the flow of a hot beverage to prevent burns.

Opening 401 has a width 306 of approximately 0.6 inches (approximately 1.524 centimeters) and an opening height 308 of approximately 0.045 inches (approximately 0.1143 centimeter). The surface area of opening 401 is about 0.027 inches$^2$ (0.1742 cm$^2$). This particular size, shape, and position of opening 401 allows for better control of the delivery of an average cup of coffee. More specifically, the size, shape, and position of opening 401 provide an optimal flow rate for beverages having similar viscosity and surface tension as coffee. If opening 401 is substantially larger, the flow rate is too fast and the user may be burned (coffee is generally served at a temperature of between 155 degrees Fahrenheit (68.33 degree Celsius) and 175 degrees Fahrenheit (79.44 degree Celsius). However, if opening 401 is substantially smaller, the surface tension of coffee can cause the coffee to build up at opening 401, which may eventually burst and cause an unexpected flow of hot coffee.

Those of ordinary skill in the art will appreciate that alternative sizes, shapes, and positions for opening 401 could be used while still providing an acceptable flow rate and controlled flow (e.g., no vacuum or surface tension build up). For example, other sizes and dimensions that still result in a surface area of approximately 0.027 inches$^2$ may still eliminate the surface tension build-up while providing an acceptable flow rate for hot beverages. Unfortunately, conventional lids that place the spout opening at the bottom of a valley and away from the user's lips (e.g., GB 2473041 and GB 2473042) typically have a spout opening that is either too too large or too small for hot beverages. When the opening is too large, the user would either have to wait until the hot beverage has cooled before taking a drink or else risk being burned. When the opening is too small, surface tension of the beverage creates build-up and trapping of the liquid at the opening; a sudden break in the surface tension leads to an unexpected rush of hot beverage, potentially causing burn injuries. Neither approach is acceptable since the user must compromise safety (e.g., being burned) or taste (e.g., drinking lukewarm coffee).

The exact size, shape, and position of opening 401 can be varied according to any number of factors, such as the beverage (e.g., juice, coffee, hot chocolate, tea, wine, water, soda, ice cream shake), beverage temperature (e.g., hot or cold), other beverage characteristics (e.g., viscosity, surface tension, presence or absence of whip cream or solids) and user environment (e.g., sitting, walking, driving). In some embodiments, opening 401 can be adjustable (see for example lid 200 in FIG. 10) to meet a user's particular preferences or application.

Lid 100 also has a second opening 402. Second opening 402 can have a second opening diameter 407 of approximately 0.1406 inches (approximately 0.3571 centimeters).

The specific values for dimensions as described herein are not meant to restrict the scope of the subject matter presented unless otherwise specified in the claims.

Figure 9:
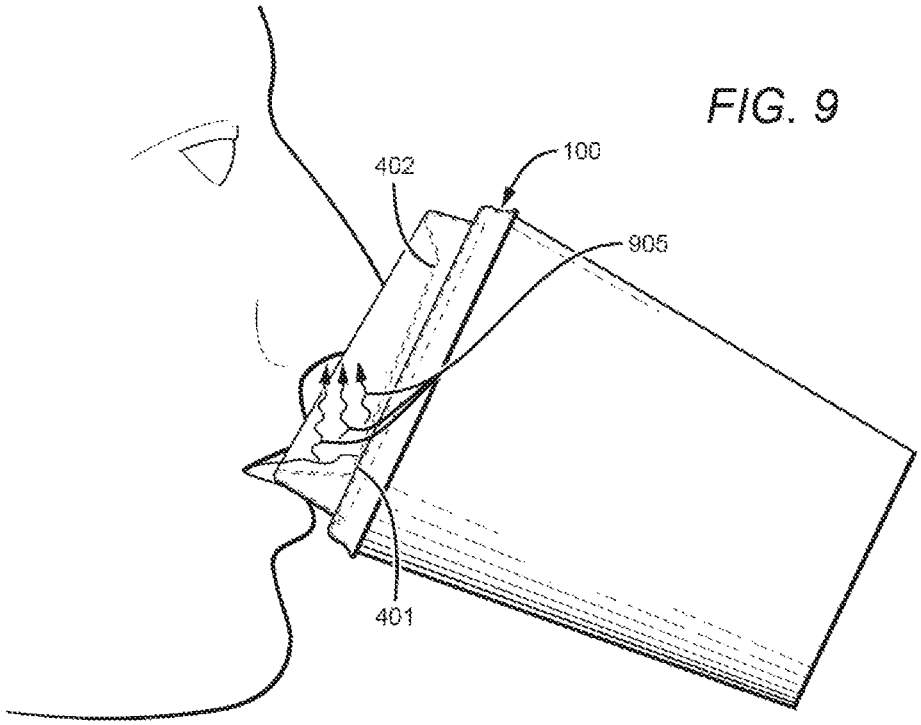
FIG. 9 is a side view of a user showing a liquid flow from the lid from FIG. 1 coupled to the container.

Basin 310 is also configured to channel and concentrate vapor rising from the liquid in the sipping portion to aroma portion. This is accomplished by shaping basin 310 such that its width becomes narrower moving from one end of its length (i.e., the drinking portion) to the other end of its length (i.e., the aroma portion). FIG. 3 shows a top view of lid 100, and best illustrates how the width of basin 310 changes along length 307 (wherein the width is the dimension between two opposing ridges). Drinking portion of lid 100 has a first width 304, which is much larger than second width 305 of aroma portion. Basin 310 is sized and dimensioned such that user's nose is closely located near the aroma portion when the user takes a drink from lid 100 as shown in FIG. 9. In this manner, lid 100 enhances the user's olfactory experience when drinking a liquid.

One advantage of lid 100 is the prevention of burning a user's upper lip. Ridge 311 of basin 310 includes two sidewalls that meet with the drinking portion at angles 480 and 481, as shown in FIG. 4. Angles 480 and 481 are approximately 135 degrees. Width 306 and angles 480 and 481 protect the user's upper lip by supporting (e.g., pushing) the upper lip off of ridge 311, such that the upper lip is away from the direct flow of the hot beverage. Width 306 and angles 480 and 481 also create a comfortable and secure feeling that allows the user to drink a hot beverage with confidence that the beverage will not spill or burn the user.

Figure 5A:
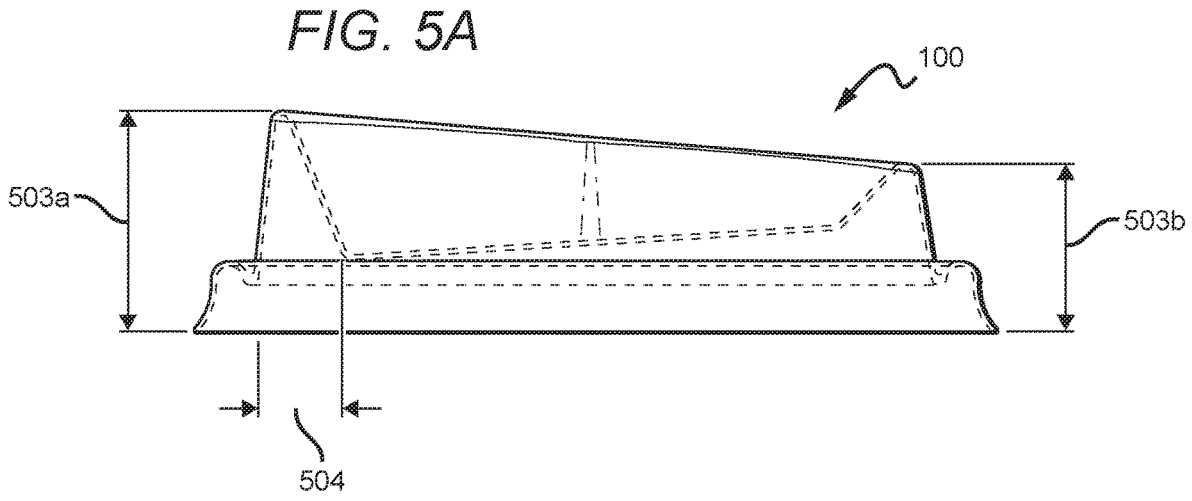
FIG. 5*a* is a side view of the lid of FIG. 1.
Figure 5B:
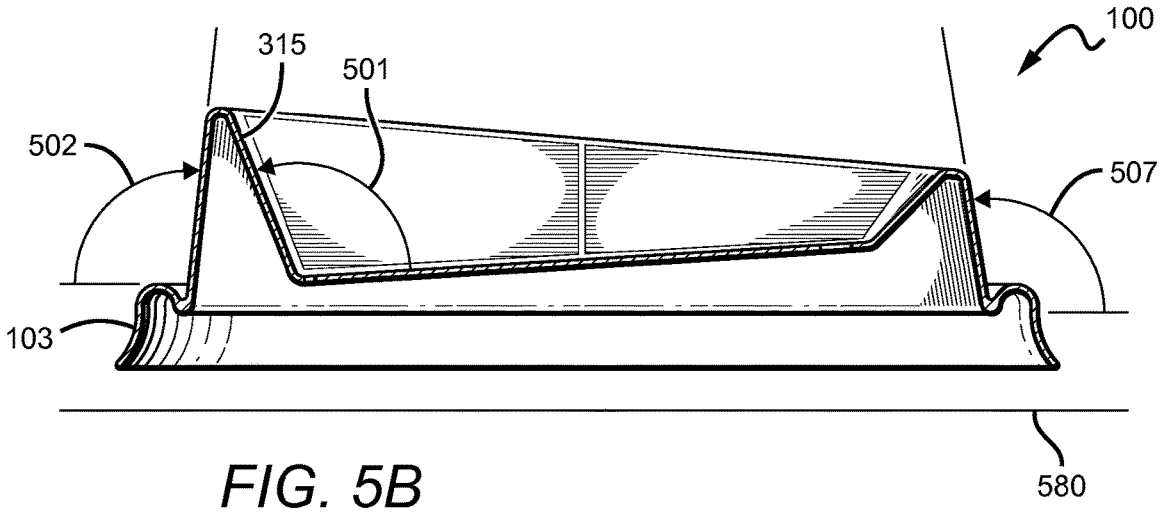
FIG. 5*b* is a side cross-sectional view of the lid of FIG. 1.

FIG. 5*a* shows a side perspective view of lid 100 with exemplary dimensions to provide a better illustration. FIG. 5*b* shows a cross-section of the side view of lid 100. As stated above, these dimensions are not meant to restrict the scope of the subject matter presented unless specified in the claims. In some embodiments, lid 100 can have a drinking portion lid height 503*a* with a height of approximately 1 inch (approximately 2.54 centimeters). Drinking portion lid height 503*a* is shown as the distance between the top of the ridge and a horizontal surface of the lid. However, drinking portion lid height 503 could also be defined as the distance between the top of the ridge and some other reference point, such as the bottom of the basin or the bottom of the outer circumferential rim. Lid 100 also has an aroma portion lid height 503*b*. The height of lid 100 tapers going from height 503*a* to 503*b*. Nevertheless, it is contemplated that the height of lid 100 can be constant (i.e., the lid height does not taper) in alternative embodiments. The tapering design of lid 100 can help a user to locate the drinking portion of lid 100 without looking at lid 100. For example, when the user is driving the user can feel the height increase of 503*a* with his or her lips, allowing the user to keep eye contact on the road.

As illustrated by the cross-sectional side view in FIG. 5*b*, the elevation of the valley of basin 310 is lower at the drinking portion and higher at the aroma portion with respect to a horizontal plane 580, which allows fluid in the valley of basin 310 to flow back into the lumen 102 of container 101 when in the resting position (e.g., when coupled with container 101 and placed on horizontal plane 580). While the valley of basin 310 has a constant slope, in alternative embodiments, the valley of basin 310 could have a non-constant slope (e.g., it could be concave), and could also be non-planar or could include impressions (e.g., mounds, bumps, textures, etc).

In addition, FIG. 5*b* shows how the elevation of the valley of basin 310 is always higher than the elevation of rim 103. However, it is contemplated that other embodiments of lid 100 can have a basin valley that is located at the same elevation as the rim or at a lower elevation than the rim. Alternations to the elevation of the basin valley and the height profile of lid 100 can be done for various reasons, such as aesthetics and convenience of design.

It should be noted that lid 100 has various slopes that can benefit the user and/or the manufacturers. FIG. 5*b* also shows angle 502, which is the angle between outward-facing wall 312 of ridge 311 (near the drinking portion) and a horizontal surface. In some embodiments, angle 502 is between 90 and 135 degrees. Angle 502 is optimized to provide a comfortable drinking angle when container 101 is tilted by a user for drinking a liquid (e.g., see FIG. 9). By providing such angle in this embodiment, the outward-facing wall 312 of ridge 311 is viewable to consumers and on lookers, which makes this space valuable for advertisements and/or messages.

Lid 100 also has a drinking portion width 504, which is the distance from opening 401 to outward-facing wall 312 of ridge 311. Width 504 defines a capture area that is sized and dimensioned to capture a small amount of liquid and/or liquid constituents (e.g., coffee grinds, contaminants from backwash drinkers, etc.). The capture area defined by width 504 can be used to prevent dispensing of unwanted portions of a beverage. In some embodiments, drinking portion width 504 can be approximately 0.4 inches (approximately 1.016 centimeters). In alternative embodiments, width 504 can be smaller or larger, depending on the desired size of the capture area. In yet other embodiments, the capture area can completely eliminated by being filled in.

FIG. 5*b* also shows angle 501, which is the angle between the inward-facing wall 313 of ridge 311 and the valley of basin 310 at the drinking portion side of the lid 100. Angle 501 is about 90 degrees. However, in other embodiments, angle 501 could be significantly less than or greater than 90 degrees.

Angle 501 and angle 502 could vary depending on numerous factors such as user preference and the particular application (e.g., tea, coffee, hot chocolate, juice, child, adult, etc). Angle 501 and angle 502 could also vary along the circumference of ridge 311 (e.g., different portions of the ridge could have different angles).

FIG. 5*b* shows angle 507, which is the angle between the outward-facing wall 312 of the ridge 311 (near the aroma portion) with respect to a horizontal surface. It is contemplated that angle 507 is between 100 and 130 degrees. By providing such angle in this embodiment, the outward facing surface of the ridge is viewable to consumers and on lookers, which makes this space valuable for advertisements and/or messages.

Figure 6:
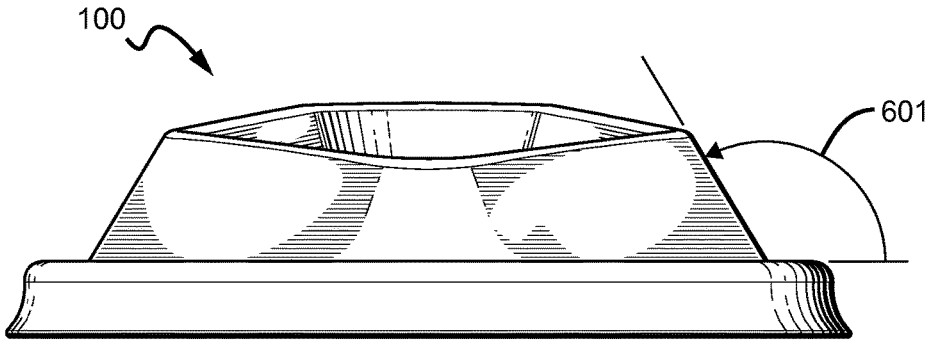
FIG. 6 is a back side view of the lid of FIG. 1.

FIG. 6 shows a back side view of lid 100 showing the aroma portion of the lid toward the front, and the drinking portion of lid 100 toward the back. FIG. 6 also shows angle 601, which is the angle between the outward-facing wall 312 of ridge 311 and a horizontal surface of the lid 100. Angle 601 is between about 135 degrees and provides a visible viewing angle for advertising text and logos (e.g., see FIG. 8*b*). The height of lid 100 (e.g., height 503*a* and 503*b*) and angle 601 together provide a visible advertising surface that can be simultaneously viewed by both the user (even when drinking from 100) and on lookers. In alternative embodiments, angle 601 of lid 100 can be changed (e.g., 125 degrees, 150 degrees, etc.) to meet the user's preference.

Figure 7:
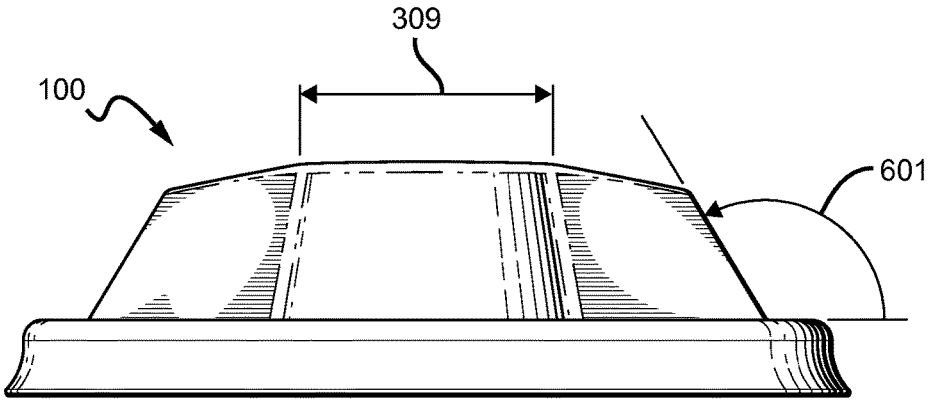
FIG. 7 is a front side view of the lid of FIG. 1.

FIG. 7 shows a front side view of lid 100 showing a width 309 of the drinking portion of lid 100. In some embodiments, width 309 is 1¼ inches.

FIG. 8 shows various perspective views of lid 100 from various angles. FIG. 8*a* shows a top perspective view of lid 100. FIG. 8*b* shows a side perspective view of lid 100, with optional logo 810 and optional branding 820. Those of ordinary skill in the art will appreciate that information other than logos and branding can be included on the outward facing surface of ridge 311. For example, the outward facing surface could include words, labels, warnings, slogans, website address, pictures, colors, matrix barcodes, Quick Response (BQ) codes, and radiofrequency identification (RFID) tags. The outward-facing surface of ridge 311 is angled such that the surface is easily visible to both the user of the lid and to those nearby.

FIG. 8*c* shows the underside of lid 100. The underside features of lid 100 allow for lid 100 to be stackable with other identical lids, thus optimizing space when storing multiple lids. Stackability provides numerous advantageous that are readily appreciated by those of ordinary skill in the art. However, in alternative embodiments, lid 100 need not be stackable. Stackability should not be construed to limit the inventive concepts unless specifically references in the claims.

FIG. 9 shows a side view of a user drinking liquid from lid 100. FIG. 9 also shows a liquid flow profile for lid 100. In addition, FIG. 9 shows the user's nose and mouth relative to lid 100. The user's mouth is close to opening 401 and the user's nose is close to opening 402. As the liquid flows from opening 401 and across sipping area 315, the liquid aerates. Vapor 905 rises and is concentrated at the user's nose due to the shape of basin 310, thus enhancing the user's olfactory experience. The effect is further augmented as the user exhales through the nose, which causes the liquid to further aerate and circulates the pleasing aroma of the liquid upward to the user's nose.

Figure 10:
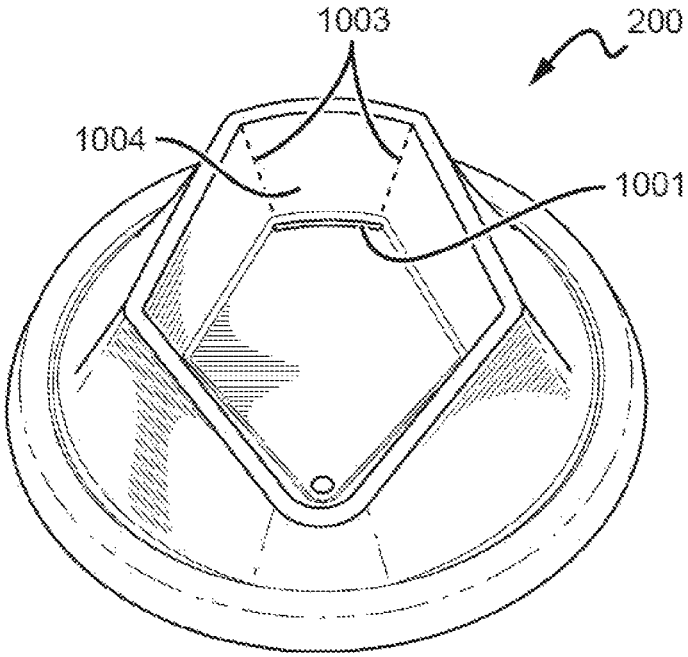
FIGS. 10-16 are perspective views of lids with basins and perforations for enlarging openings on the lid.

FIG. 10 shows another embodiment of a lid 200 with perforations 1003. When a user desires to enlarge opening 1001 to increase the flow of the liquid, the user can press down between perforations 1003 to simply widen the opening, and/or alternatively, the user can partially or completely remove a portion of the inward-facing wall 1004 of the drinking portion of lid 200. The user can control how much opening 1001 is enlarged by gradually pinching inward-facing wall 1004 and the outward facing wall with the thumb and index fingers.

Figure 11:
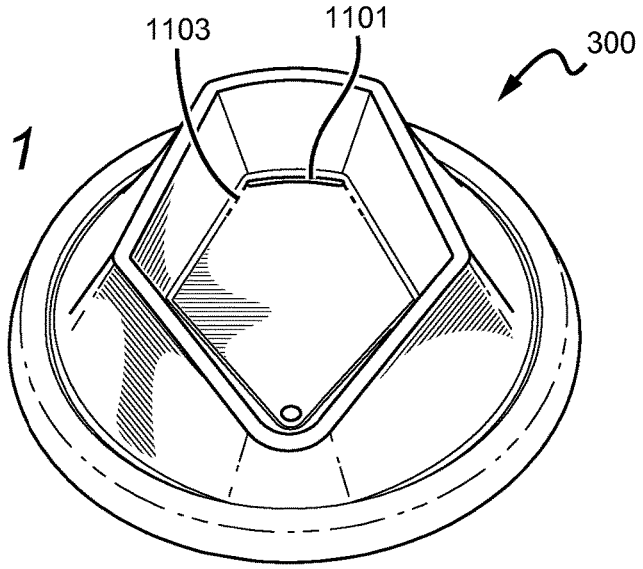

FIG. 11 shows another embodiment of a lid 300 with perforations 1103. Lid 300 comprises a first crease 1105 that separates a first portion 1109 of the inward facing surface with a second portion 1111 of the inward facing surface, and a second crease 1107 that separates the first portion 1109 of the inward facing wall with a third portion 1113. When a user desires to enlarge opening 1101 to increase the flow of the liquid, the user can press down the basin in between perforations 1103 to simply widen the opening. In addition, the user can partially or completely remove a portion of the basin of the drinking portion of lid 200.

Figure 12:
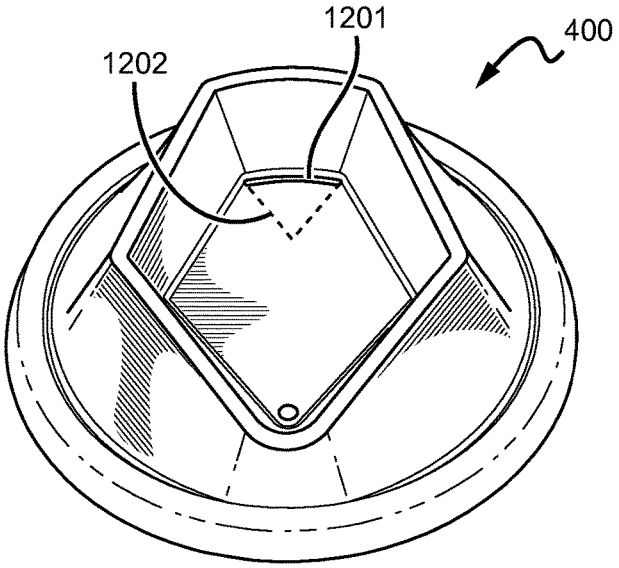
Figure 13:
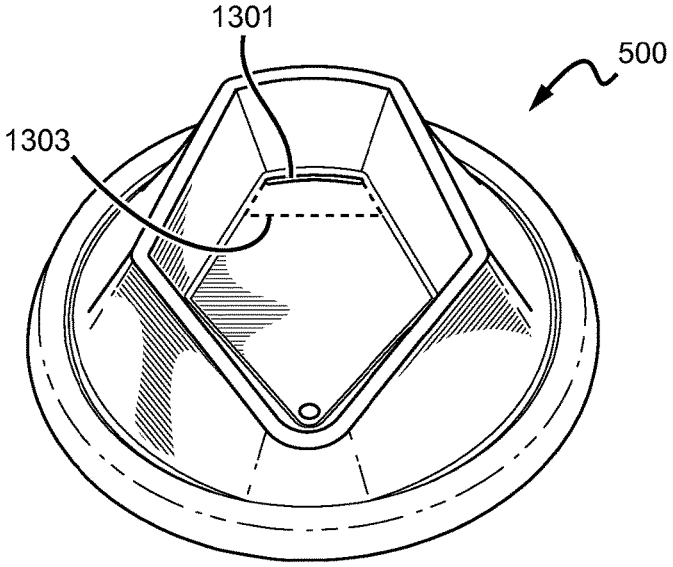

FIG. 12 shows another embodiment of a lid 400 and FIG. 13 shows another embodiment of a lid 500. In FIG. 12, perforations 1202 and opening 1201 are coupled to make a triangle shape, and are configured to make an enlarged opening when the user presses down a portion of basin surrounded by the opening 1201 and perforations 1202. The portions of the basin surrounded by the opening and perforation can be detached from the rest of the basins when they are pressed down. In FIG. 13, perforations 1303 and opening 1301 are coupled to make a trapezoid shape, and are configured to make an enlarged opening when the user presses down a portion of basin surrounded by the opening 1301 and perforations 1303.

Figure 14:
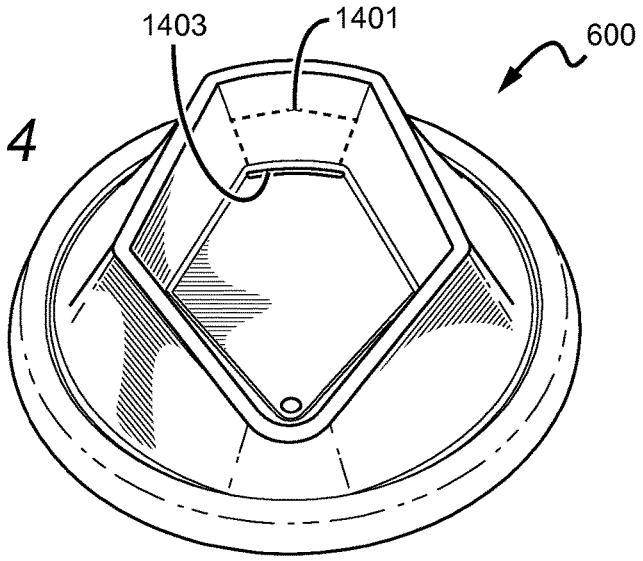

FIG. 14 shows another embodiment of a lid 600 with perforations 1401 on the inward facing wall of the drinking portion of lid 600. In this embodiment, perforations 1401 and opening 1403 are coupled to make a pentagonal shape, and are configured to make an enlarged opening when the user pinches the inward and outward facing walls of the perforated ridge.

Figure 15:
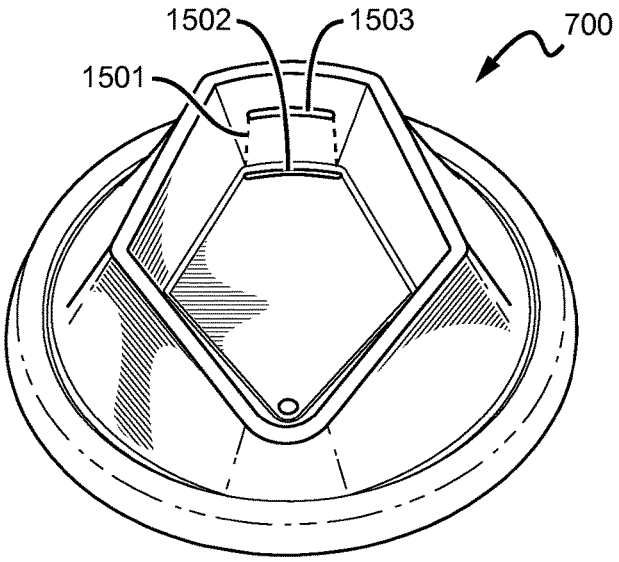

FIG. 15 shows another embodiment of a lid 700 with perforations 1501 on the inward facing wall of the drinking portion of lid 700. The perforations 1501 are coupled to an opening 1503 and an opening 1502 on the inward facing wall, and the user can enlarge the opening by pinching the outward and inward facing walls of the ridge.

Figure 16:
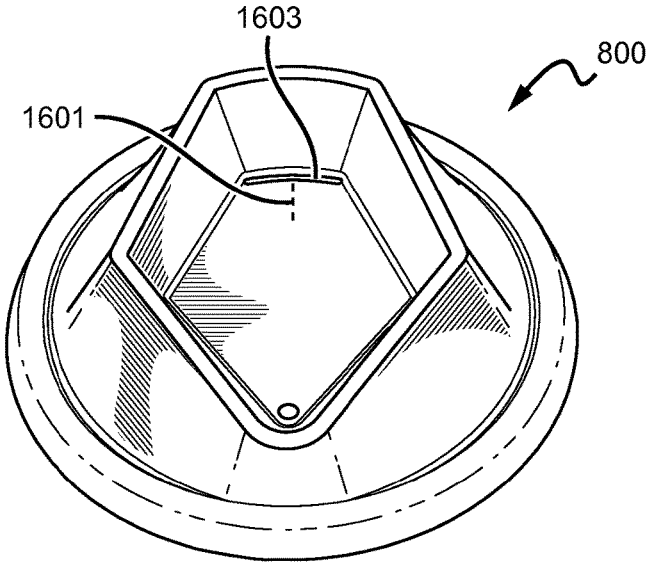

FIG. 16 shows another embodiment of a lid 800 with perforations 1601 on the basin. This embodiment enables a user to enlarge the opening 1603 in a triangular shape by pressing down perforations 1601.

FIGS. 17*a* and 17*b* show various views of a lid 900. Lid 900 is similar to lid 100 except that it has a third circular opening 901 on the inward facing wall of the drinking portion of the lid in addition to a first slit opening 902 and a second opening 903. Distance 904 from the valley of the basin to the third circular opening 901 is approximately between 0.118 inches (0.2997 centimeters) to 0.394 inches (1.001 centimeters). The diameter of the third circular opening 901 is approximately 0.098 inches (approximately 0.2489 centimeter). When lid 100 is tilted and used for drinking a liquid (e.g., see FIG. 9), liquid flows out of opening 901 and 902. The liquid flowing from opening 901 can act as a speed bump to slow down the liquid flowing from opening 902. The exact size, shape, and position of opening 901 can be adjusted, depending on the viscosity of the liquid and the situation (e.g., hot beverage, cold beverage, drinking while in motion, drinking while stationary, etc.)

FIG. 18 is another embodiment of a lid 1000. Lid 1000 also has a diamond shaped opening 1805 and a diamond shaped opening 1802 that allows a more controlled flow of the liquid to the user's mouth. More specifically, the liquid that exits at opening 1802 helps to control the flow of the liquid coming from opening 1803 by slowing down the liquid coming from opening 1803. Opening 1802 also helps to prevent the sudden rush of liquid caused by a break in a vacuumed seal or by an unexpected tilt or jolt of container 101 (e.g., such as when passing over a bump on the road while driving). Diamond shaped opening 1802 is located at a position of one third of the height of inward-facing wall from the valley of basin 1806 where opening 1803 is located. Other shapes are also contemplated for diamond shaped opening 1802, such as a triangle, a circle, a rectangle, and a square.

FIG. 18*b* shows a top view of lid 1000 with various dimensions labeled to provide a better illustration. Specific dimensions are not meant to restrict the scope of the subject matter presented unless otherwise specified in the claims. In some embodiments, opening 1803 can have an opening width 1814 of approximately 0.6 inches (approximately 1.524 centimeters) and an opening height 1810 of approximately 0.045 inches (approximately 0.1143 centimeter). The size and shape of opening 1803 allows delivery of the beverage with control for the user by reducing the chances of splattering. As discussed above, lid 1000 also has an opening 1805. Opening 1805 can have a width 1812 of approximately 0.05 inches (approximately 0.127 centimeter) and a height 1811 of approximately 0.19 inches (approximately 0.4826 centimeter).

Figure 19A:
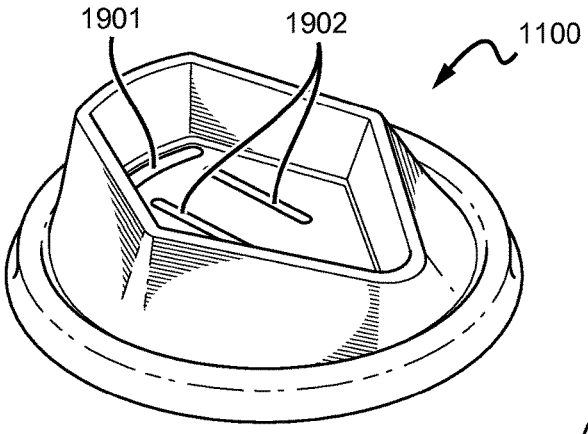
FIGS. 19*a-b* are perspective views of another embodiment of a lid with a basin.
Figure 19B:
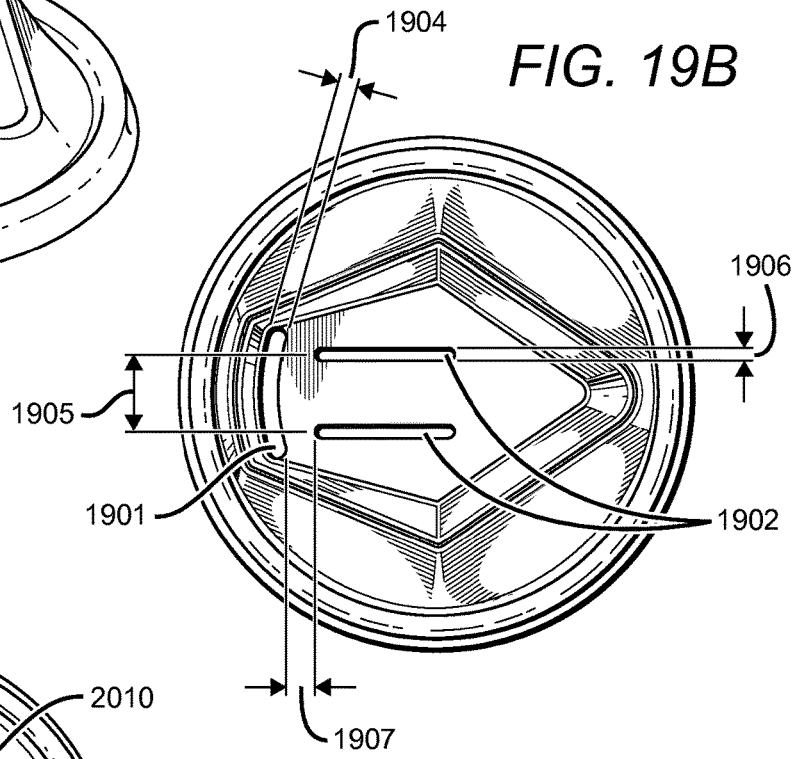

FIGS. 19*a* and 19*b* shows another embodiment of a lid 1100, which has a third and a fourth slit openings 1902, which are parallel with each other, on the basin in addition to a slit opening 1901. Slit openings 1902 have a width 1906. Preferably, two additional slit openings 1902 are positioned lengthwise from the drinking portion to the aroma portion of the lid 1100. Yet, it is contemplated that the two slit openings can be placed at any angle relative to the length between the aroma portion and the drinking portion of lid 1100.

FIG. 19*b* shows a top view of lid 1100 with various dimensions labeled to provide a better illustration. In this embodiment, opening 1901 has a depth 1904 of approximately 0.045 inches (approximately 0.1143 centimeters). The size and shape of opening 1901 allows delivery of the beverage with control for the user by reducing the chances of splattering. Lid 1100 has additional two slit openings 1902 on the basin. In this embodiment, two additional slit openings have an opening width, measured longitudinally from the drinking portion of the lid to the aroma portion of the lid, of approximately between 0.50 inches (1.27 centimeters) and 0.75 inches (1.905 centimeters). The width of at least one of the two additional openings is approximately 0.125 inches (approximately 0.3175 centimeters). The distance 1905 between two additional slit openings is approximately 0.50 inches (approximately 1.27 centimeters), and the distance 1907 between the first opening to at least one of the two additional slit openings is approximately 0.25 inches (approximately 0.635 centimeters). The additional slits 1902 help to enhanced the user's olfactory experience, especially while the user gently blows down on opening 1901.

Figure 20A:
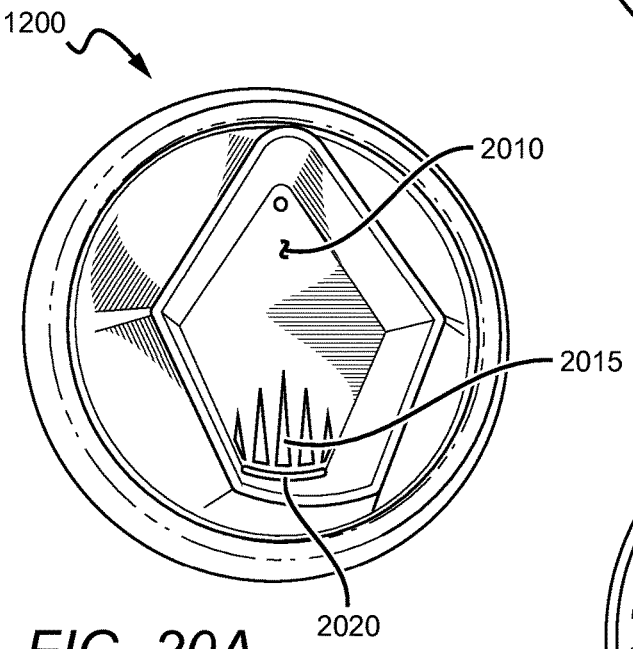
FIGS. 20*a-b* are perspective views of another embodiment of a lid with a basin.
Figure 20B:
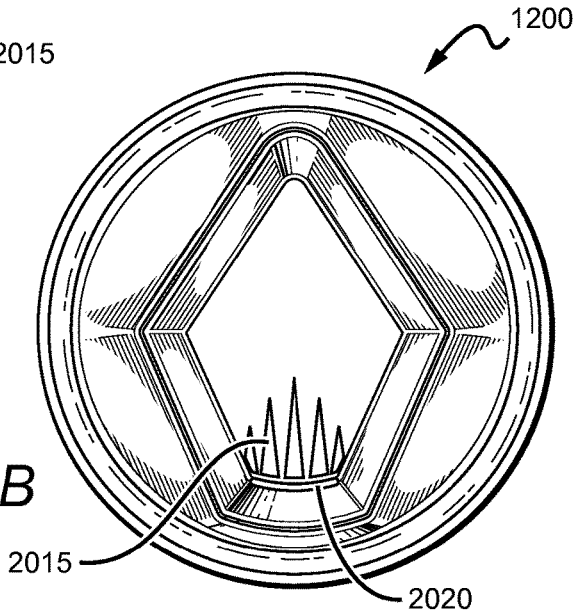

FIGS. 20*a* and 20*b* show perspective and top views, respectively, of a lid 1200. Lid 1200 has a basin 2010, which has a plurality of openings 2015 in addition to a slit opening 2020. In this embodiment, the openings 2015 are triangular, where the triangle in the center has a larger dimension than other triangles located laterally. Openings 2015 are located juxtaposed to the opening 2020 so as to increase the size of opening for dispensing liquid and to increase aroma.

FIGS. 21*a* and 21*b* show another embodiment of a lid 1300. Lid 1300 has a ridge and/or a slit opening 2101 on the basin valley, which can be pulled or pushed down to make a larger opening on the basin for dispensing liquid. Ridge and/or slit opening 2101 is coupled to perforations 2102 so that when ridge 2101 is pulled or pushed down, a portion of basin surrounded by ridge 2101 and perforations 2102 can be detached from the basin. Ridge 2101 is concave, however, in alternative embodiments ridge 2101 could be linear, half-round, half-rectangular, or any other shape suitable to pinch, pull, or push down a portion of basin valley.

FIGS. 22*a* and 22*b* show a top view and a perspective view of another embodiment of a lid 1400, which has an egg-shaped basin 2201.

FIGS. 23*a* and 23*b* show a top view and a perspective view of another embodiment of a lid 1500. The lid 1500 has a triangular-shaped basin 2301 with a rounded side and a rounded corner.

FIGS. 24 and 25 show lid 2400 and lid 2500, respectively. Lid 2400 has a textured basin valley 2401 comprising a plurality of impressions (e.g., mounds, bumps, etc.) placed in a staggered/angled pattern. Lid 2500 has a textured basin valley 2501 comprising a plurality of circular ridges. The textured basin valleys help to retain a wet coating after wetted by the beverage, thus enhancing the olfactory experience even more.

From a method perspective, when a user wishes to imbibe the beverage, the user would place their bottom lip near the edge of ridge at drinking portion. The user would tilt the container allowing the liquids to flow through openings in a controlled manner. The liquids would collect within sipping area. Simultaneously, opening would allow the exchange of air between lumen of container and the surrounding environment, thus preventing a vacuum (e.g., backpressure) from forming (which could disrupt the even flow of the liquids from opening). The user would then be able to sip the liquids at their leisure. Through the aforementioned process, users are able to prevent the sudden and uncontrolled rush of potentially searing hot fluids from hitting their lip and mouth.

The lids described above may provide numerous advantages over prior art lids. Some of those advantages will now be described.

Many of the embodiments give the user greater control over the flow rate of the beverage, which is particularly advantageous for drinking hot coffee or hot tea. In addition, the plastic can be naturally torn upward when pinched forward at the base of the slit opening in the reservoir. This creates a larger opening for liquid to pass through where the original slit was, increasing the flow. However it will not widen the point at which it comes into contact with the user's mouth. This feature provides a distinct advantage over prior art lids. The tapered narrow lip design at the top of the front of the lid is not affected from the tear so the user's control of sloshing while drinking is still intact. This design feature can be implemented when the user would like to increase flow of beverage in instances when the liquid is not at a temperature above 140 degrees Fahrenheit (60 degree Celsius) or when beverage is of a more viscous nature such as drinks with whipped topping. This increase of flow with the larger opening option may not be recommended while liquid is above 140 degrees Fahrenheit (60 degree Celsius) and uncomfortably hot for the user, since an increased flow can create a heightened chance of burning or discomfort to the user while consuming, especially while on the go.

Embodiments that include a slit spout opening provide better control of flow rate, meaning the appropriate volume of liquid is being delivered to the user at an appropriate velocity for a given beverage temperature (i.e., a sufficient amount of liquid is being delivered to the user at any given moment and at a comfortable speed). The controlled flow helps to reduce the risk of burning.

Most embodiments can be modified to include small cuts along the interior ridges running up the basin walls from the corners of the front slit such that the opening can be enlarged by pinching the bottom of the opening. This allows the user to adjust the opening size and the flow rate. For example, as a hot beverage cools down, the user may wish to increase the flow rate. Also, if a user is no longer moving, the user may wish to increase the flow rate. Or if the user has finished drinking a liquid portion of the beverage and wants to consume a foamy whipped topping, the user may increase the opening.

Some embodiments give the consumer the option to increase flow without widening the channel of point of entry where liquid enters user's mouth. By simply pinching together the front spout at the front slit opening, the plastic will naturally and easily tear up towards the top without affecting the channel or exterior.

Some embodiments could be further enhanced by two simple cuts rising up from the corners of the front slit spout. The cuts could follow the natural creases of the interior. The cuts would not leak any liquid unless pushed open by user, which would control flow and change flow only if desired.

Embodiments that have the increased opening feature also guarantees that the user can get every last drop of the drink. There is no trapped liquid when this option is exercised.

The increased opening feature is also beneficial for someone who is not on the go (e.g., someone sitting at their desk at the office) but would like to keep their beverage covered to keep it warmer longer. Since the user is not in motion, the user can afford to increase the flow by increasing the opening, which will also enhance the olfactory experience.

Many of the embodiments above also provide safety splash and spill advantages. For example, the basin walls act as a splash guard and reduces the chances that the user will be burned when the beverage container is jolted (e.g., user drives over a bump in the road). In addition, if the beverage container is accidentally tipped over, the restricted opening reduces flow rate of the liquid and thus reduces the amount of spilt liquid. Moreover, if the container is shaken, the lid reduces spill and has a sloping basin valley that returns liquid to the container, unlike most conventional lids where the liquid has nowhere to come to rest. With a conventional lid the consumer may be burned by the liquid that pools on the outer surface of the lid, which could have very serious consequences when the consumer is operating a vehicle.

Many embodiments provide an enhanced olfactory experience since the basin valley provides an area for liquid to collect and slowly flow back into the container reservoir at a controlled flow rate. The liquid is given time to aerate and, when the lid is tilted, the basin walls act to channel and concentrate aroma vapors towards the user's nose.

In addition, a large basin valley (e.g., recessed reservoir) allows for a larger vacuum hole (e.g., 0.125 inches (0.3175 centimeters) to 0.1875 inches (0.4762 centimeters)) compared to many prior art lids. This larger vacuum hole ensures a smoother flow from the drink spout up front and helps to guarantee that liquid will not be trapped in the container. In the event some liquid is released from the vacuum hole, it will be safely returned to the container leaving an aromatic coating of liquid behind. The large surface area of the basin valley creates a larger aromatic coating, thus enhancing the consumer's olfactory experience.

In some embodiments the basin has an angular shape. With the unique angular shape the user can quickly identify where the drinking spout is without looking at the container. This is beneficial in situations where visibility is low (e.g., at night or in a dark room) or when the user just needs to keep their eyes on the road while driving in heavy traffic.

In many embodiments, the basin valley does not dip below the rim of the cup, which allows the consumer to fill the cup all the way up. Most embodiments are designed to be stackable so that space is conserved when multiple lids are stored and/or transported.

Many embodiments also make it easy for the barista to quickly identify the drinking spout area of the lid so that there will be less of a chance that he/she will come into contact with it and thus limiting the chance of cross contamination.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of enlarging an opening on a lid, wherein the lid comprises:

a ridge that at least partially surrounds a valley disposed at a center of the lid, wherein the ridge comprises an inward facing surface that faces towards the center of the lid and an outward facing surface that faces away from the center, and wherein the inward and outward facing surfaces converge;

wherein the inward facing surface comprises a sipping portion that meets with a first sidewall at a first crease and a second sidewall at a second crease each at an angle greater than 90 degrees such that a width extending from the first sidewall to the second sidewall increases moving away from the first and second creases; and an opening disposed on the valley between the first and second crease;

the method comprising the step of pinching together a portion of the inward facing surface with an opposing portion of the outward facing surface at a location between the first crease and second crease to create a first tear that travels in an upward direction on the inward facing surface and thereby enlarges the opening.

2. The method of claim 1, wherein the inward-facing surface comprises at least one tear line.

3. The method of claim 2, wherein the tear line is disposed on the inward facing surface between the first crease and the second crease.

4. The method of claim 2, wherein the tear line extends from the opening.

5. The method of claim 4, wherein the step of pinching comprises using one of a thumb and index finger on the inward facing surface and one of a thumb and index finger on the outward facing surface to thereby pinch together the portion of the outward facing surface and the portion of the inward facing surface.

6. The method of claim 4, further comprising a step of adjusting a size of the opening based on at least one of a temperature and viscosity of a beverage stored in a container coupled to the lid.

7. The method of claim 2, further comprising a first tear line and a second tear line that each comprise a plurality of perforations that extend from corners of the opening.

8. The method of claim 1, wherein the first tear travels along the first crease.

9. The method of claim 8, wherein the step of pinching creates a second tear on the ridge.

10. The method of claim 9, wherein the second tear travels along the second crease.

11. The method of claim 1, wherein the step of pinching comprises using one of a thumb and index finger on the inward facing surface and one of a thumb and index finger on the outward facing surface to thereby pinch together the portion of the outward facing surface and the portion of the inward facing surface.

12. The method of claim 1, further comprising a step of adjusting a size of the opening based on at least one of a temperature and viscosity of a beverage stored in a container coupled to the lid.

13. The method of claim 1, wherein the outward facing surface comprises a first portion disposed between the first and second crease.

14. The method of claim 13, wherein the first portion of the outward facing surface forms an angle less than 270 degrees with a second portion of the outward facing surface at the first crease.

15. The method of claim 14, wherein the first portion of the outward facing surface forms an angle less than 270 degrees with a third portion of the outward facing surface at the second crease.

16. A method of enlarging an opening on a lid, wherein the lid comprises:

a ridge that at least partially surrounds a valley disposed at a center of the lid, wherein the ridge comprises (i) an inward facing surface having a first portion, a second portion, and a third portion that face towards the center of the lid, and (ii) an outward facing surface that faces away from the center;

a first crease disposed at an intersection between the first portion and the second portion of the inward facing surface;

a second crease disposed at an intersection between the first portion of the inward facing surface and the third portion of the inward facing surface;

wherein a width between the second portion and third portion increases moving away from the first and second creases;

an opening disposed on the valley between the first and second creases;

the method comprising the step of pinching together the first portion of the inward facing surface with the outward facing surface at a location between the first crease and second crease to create a first tear that travels in an upward direction on the inward facing surface to thereby enlarge the opening.

17. The method of claim 16, wherein the first portion forms an angle greater than 90 degrees with the second portion.

18. The method of claim 16, wherein the first portion forms an angle greater than 90 degrees with the third portion.

* * * * *